US007661228B1

(12) United States Patent
Nolte et al.

(10) Patent No.: US 7,661,228 B1
(45) Date of Patent: Feb. 16, 2010

(54) ARMORED BUILDING MODULES AND PANELS

(75) Inventors: Roger Allen Nolte, Jackson, MO (US); Donald L. Selke, Waterloo, IN (US)

(73) Assignee: Kontek Industries, Inc., New Madrid, MO (US)

( * ) Notice: Subject to any disclaimer, the term of this patent is extended or adjusted under 35 U.S.C. 154(b) by 939 days.

(21) Appl. No.: 11/123,624

(22) Filed: May 6, 2005

(51) Int. Cl.
*E04H 1/00* (2006.01)
*E04C 3/00* (2006.01)

(52) U.S. Cl. ..... 52/79.1; 109/79; 52/578; 52/579

(58) Field of Classification Search ..... 52/79.1, 52/578–581, 794.1, 269, 302.1; 109/1 S, 109/79
See application file for complete search history.

(56) References Cited

U.S. PATENT DOCUMENTS 2,153,204 A * 4/1939 Olson ..... 52/784.1
3,962,976 A 6/1976 Kelsey
4,036,104 A 7/1977 Pagano et al.
4,108,072 A 8/1978 Trinks et al.
4,198,454 A 4/1980 Norton
4,355,562 A 10/1982 Sewell et al.
4,550,044 A 10/1985 Rosenberg et al.
4,566,237 A 1/1986 Turner
4,748,790 A 6/1988 Frangolacci
4,822,657 A 4/1989 Simpson
4,901,622 A * 2/1990 Perry ..... 89/36.02
4,928,468 A 5/1990 Phillips
4,948,673 A 8/1990 Goeury
4,965,138 A 10/1990 Gonzalez
5,050,362 A 9/1991 Tal et al.
5,114,772 A 5/1992 Vives et al.
5,149,910 A 9/1992 McKee
5,204,149 A * 4/1993 Phenicie et al. ..... 428/57
5,214,235 A 5/1993 Froeschner
5,221,807 A 6/1993 Vives
5,326,606 A 7/1994 Labock
5,386,788 A * 2/1995 Linker et al. ..... 109/58
5,654,518 A 8/1997 Dobbs
5,723,201 A 3/1998 Czetto
5,723,807 A * 3/1998 Kuhn, II ..... 89/36.02
5,758,467 A * 6/1998 Snear et al. ..... 52/592.1
5,763,813 A 6/1998 Cohen et al.
5,792,974 A 8/1998 Daqis et al.
5,847,308 A 12/1998 Singh et al.
6,009,789 A 1/2000 Lyons
6,021,703 A 2/2000 Geiss (Continued)

*Primary Examiner*—Richard E Chilcot, Jr.
*Assistant Examiner*—Mark R Wendell
(74) *Attorney, Agent, or Firm*—Barclay J. Tullis

(57) ABSTRACT

Panels and their modules, such as for walls and roofs, are disclosed that provide armored shelter for protecting people and equipment from ballistic projectiles and mortar attacks. Each module is made from multiple co-parallel plates arranged in a stack, spaced apart, and held together along their sides by side elements. This is done in such a way that, when assembled side-by-side or end-to-end into panels, adjacent modules overlap one another to prevent straight-through seams yet allow any damaged module to be removed and replaced without moving adjacent modules. Space within a module, between plates and sides, can contain energy absorbing material in a variety of shapes. Plates serve as structural flanges, and side elements comprise structural webs, to permit each module to function as a structural beam.

20 Claims, 12 Drawing Sheets

U.S. PATENT DOCUMENTS 6,047,626 A 4/2000 Lair et al.
6,061,987 A 5/2000 King
6,085,485 A 7/2000 Murdock
6,216,579 B1 4/2001 Boos et al.
6,324,796 B1 * 12/2001 Heath ..... 52/177
6,345,563 B1 2/2002 Middione et al.
6,412,231 B1 * 7/2002 Palatin ..... 52/79.1
6,497,966 B2 12/2002 Cohen
6,575,075 B2 * 6/2003 Cohen ..... 89/36.02
6,591,567 B2 * 7/2003 Hota et al. ..... 52/578
6,619,181 B1 9/2003 Frey et al.
6,637,163 B2 * 10/2003 Thibault et al. ..... 52/177
6,642,159 B1 11/2003 Bhatnagar et al.
6,658,808 B1 12/2003 Doherty et al.
6,698,331 B1 3/2004 Yu et al.
6,793,291 B1 9/2004 Kocher
7,000,550 B1 * 2/2006 Mandall ..... 109/49.5
7,047,697 B1 * 5/2006 Heath ..... 52/177
7,160,055 B2 * 1/2007 Beamish et al. ..... 404/36
7,458,305 B1 * 12/2008 Horlander et al. ..... 89/36.01
2001/0032541 A1 10/2001 Benyami et al.
2004/0083880 A1 5/2004 Cohen
2004/0083935 A1 * 5/2004 Alizade ..... 109/49.5
2004/0159228 A1 8/2004 Budnik
2004/0197542 A1 10/2004 Benitsch
2004/0237763 A1 12/2004 Bhatnagar
2008/0047418 A1 * 2/2008 Warren et al. ..... 89/36.02

* cited by examiner

Fig. 13A
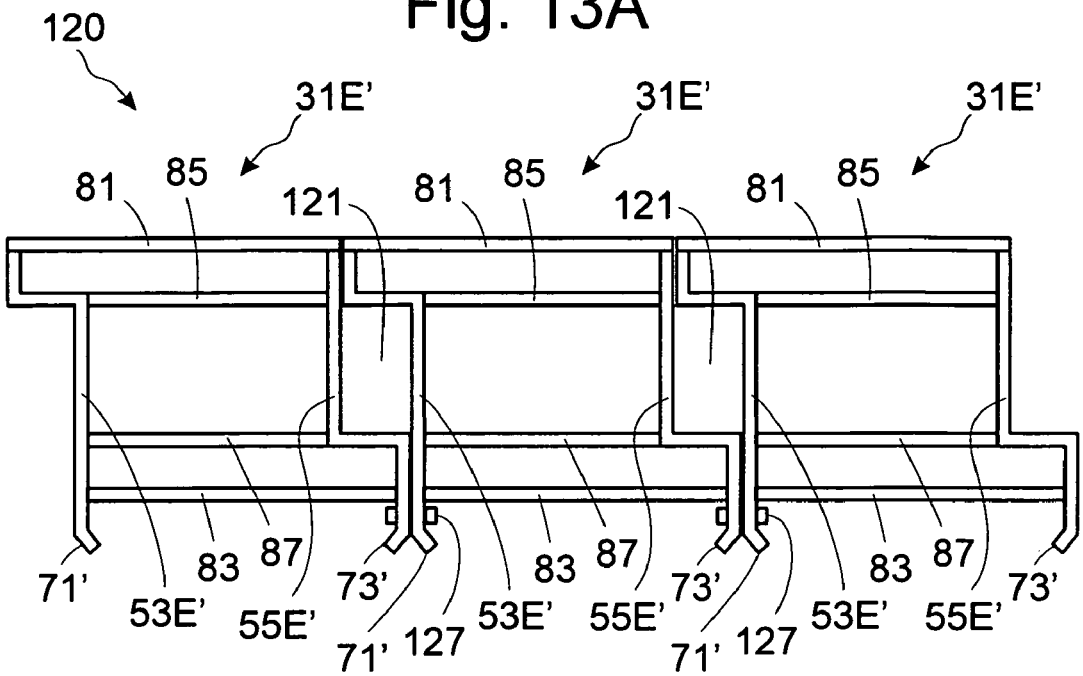
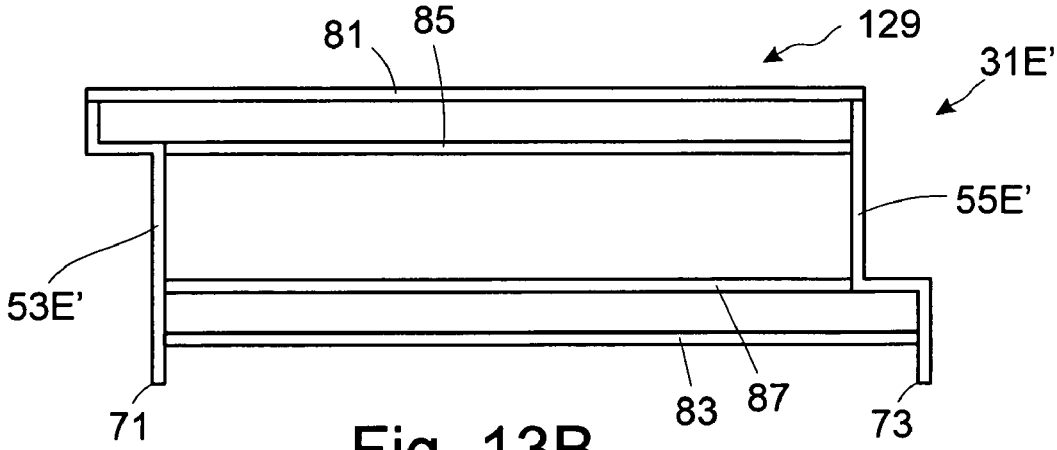
Fig. 13B
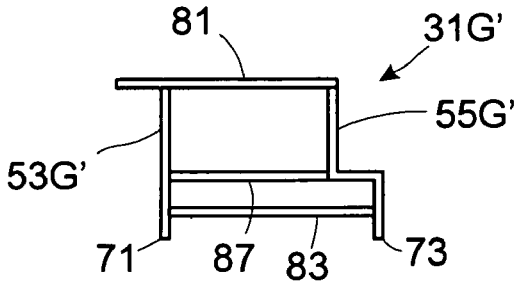
Fig. 13C
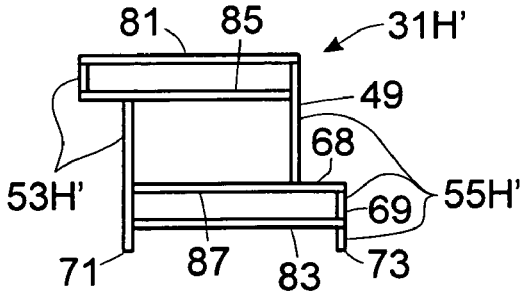
Fig. 13D

Fig. 14A
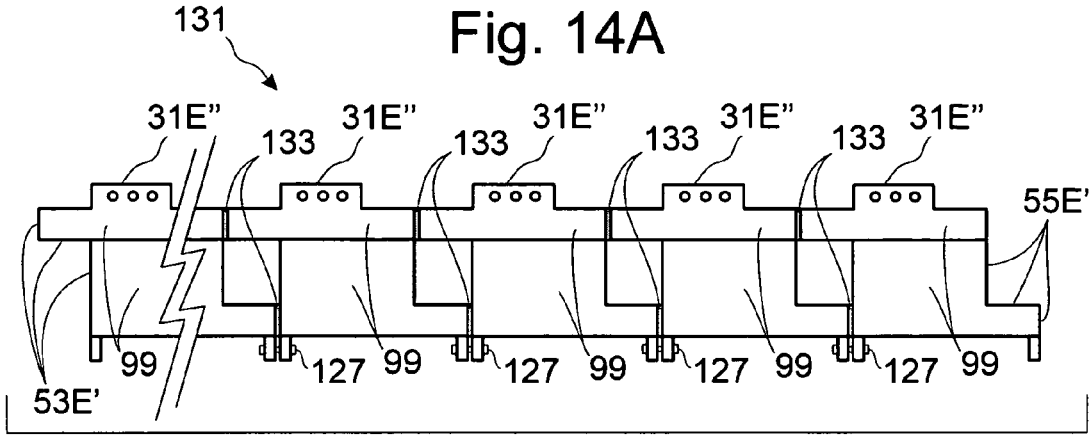
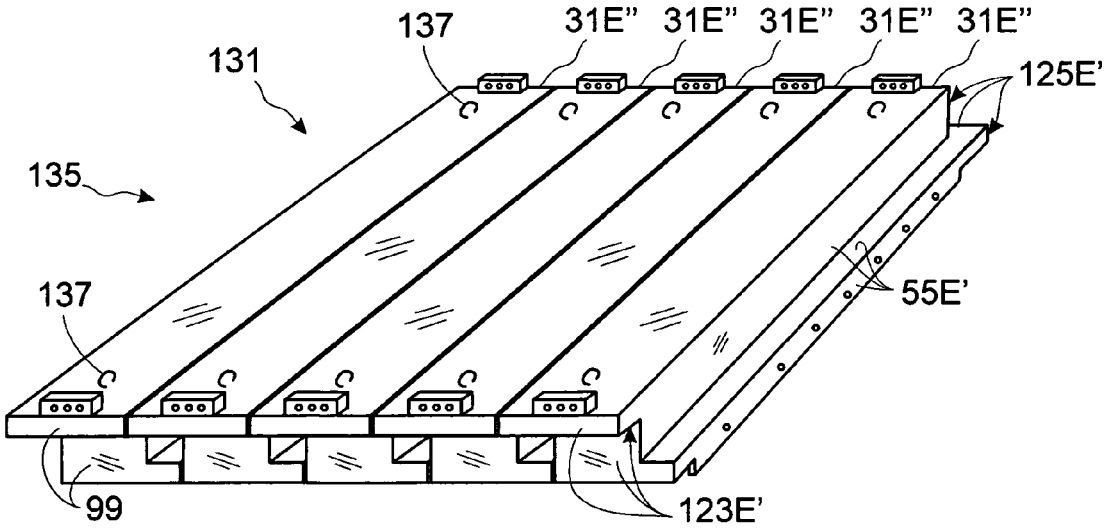
Fig. 14B

ARMORED BUILDING MODULES AND PANELS

BACKGROUND OF THE INVENTION

1. Field of the Invention

This invention relates to armored building modules and panels, such as for walls and roofs, that provide armored shelter to protect people and equipment from ballistic projectiles and mortar attacks, and in particular to armored building modules each made from multiple, co-parallel, plates arranged in a stack but spaced apart and held together along their sides by side elements. In this invention, plates serve also as structural flanges, and side elements comprise structural webs to permit each module to function as a structural beam.

2. Description of the Related Art

Above-ground shelters for protecting people and/or facilities in a war zone generally require protective armor to mitigate damage that can be caused by impacts and blasts from various ballistic projectiles and mortars. Historically, bunkers have been protected against mortar threats by constructing roofing using a combination of logs and dirt, and later by timbers supporting one or more layers of sandbags. More recently, building units of massive concrete and thick plates of high-strength steel have been used for these purposes. These prior arts have relied upon heavy materials, and more recently on expensive materials. None of the prior arts have taken advantage of structures made mostly of common-grade steel plates. And the prior art has not provided rapidly deployable steel structures suitable for protecting against mortar impacts and consequent mortar blasts.

U.S. Pat. No. 4,928,468 to a "Building Panel Module" discloses building panel modules made of steel sheets formed to provide internally cantilevered baffles that are said to provide deflecting and energy absorbing means against incident ballistic projectiles. The building panel modules disclosed therein also each have front and rear sheets interconnected only at longitudinal ends by end caps, not along longitudinal edges. The end caps are what structurally provide resistance to bending caused by blasts from external explosive devices that might be used by terrorists or others to gain entry to a building constructed of such modules. From each of the sheets comprising front and back panel elements within a module are inwardly extending legs that lie perpendicular to planes defined by the front and back panels and which extend to internally situated flanges which function as baffles lying parallel to the front and back panel elements. Each module shape disclosed therein includes at least one of the front or back face panels being strengthened by an I-beam configuration comprised of the aforementioned webs and flanges where two adjacent sheet elements are welded together longitudinally. Each of these I-beam shapes give strength only to a single face panel as they do not touch or attach to the opposing face panel. Therefore, the I-beams strengthen the front and back face panels individually but not the interconnection of the face panels, as the front and back face panels are interconnected only at the longitudinal ends of a module assembly.

In contrast to that invention of U.S. Pat. No. 4,928,468, the current invention has the following different features:

a) there are no I-beam shapes in a transverse cross-section of a module of the current invention;

b) generally flat plates whose faces lie parallel to a longitudinal axis (defining longitudinal directions) of a module in the current invention are rigidly tied together along the longitudinal length of a module, thus providing a single continuous beam-like structure as opposed to two parallel beam-like structures that only attach together at their longitudinal ends;

c) a transverse cross-section of a module of the current invention shows two side lap overhangs that form arms of a generally Z-shaped structure, wherein these arms are spaced apart from one another in two orthogonal directions each perpendicular to longitudinal directions of the module;

d) as a result of the feature in item "c" above, when one panel module is positioned edge-to-edge (i.e. side-by-side) between two neighboring modules forming at least a portion of a panel, it can be removed by a combination of transverse translations of the module;

a) each module of the current invention is comprised of at least one longitudinal channel (e.g. pocket) bounded by two oppositely-facing generally flat plates (or flanges) and by two oppositely-facing side members, wherein the channel can receive inserted energy absorbing means (for absorbing projectile and blast energy) such as a metallic mesh, a plastic foam, one or more longitudinal and metallic tubes, and/or similar additional materials that can absorb kinetic and thermal energy from a mortar shell and blast;

f) seen in transverse cross-section, each module is constructed of two, three, four, or more co-parallel flat plates (or flanges) of metal connected at least at one of two sides (e.g. transverse edges) by one of two respective metal sides, as opposed to not being connected at all along the sides (e.g. transverse edges);

a) there is no plate, flange, or web in the current invention that has an inwardly cantilevered edge as viewed in a transverse cross-section;

a) there is at least one continuous plate or flange that is co-parallel with the first and second (e.g. front and back) plates and that is also connected to both of two transversely opposing side members;

a) side lap overhangs and end lap overhangs in the current invention respectively provide means for side-by-side and end-to-end nesting of adjacent modules in a manner that prevents clear-through seams existing between adjacent modules; whereas these lap overhangs don't provide such means if one module is flipped in orientation, relative to the others, around a transverse axis;

U.S. Pat. No. 4,748,790 to a "Shelter with Armoring Composite Walls and Doors", discloses a shelter designed with both an interior panel having at least one metal side, for the purpose of electromagnetic shielding, and an external armoring panel, with an airspace in between these inner and outer panels, and wherein these panels are supported along their outer edges by a metal framing structure, and wherein the armoring panel is made to float by being mounted with energy absorbing material. There is no teaching or suggestion within that patent on the configuration or use of building modules, nor any teaching of the internal structure of the armoring panels.

U.S. Pat. No. 5,050,362 to "Constructional Panels" and U.S. Pat. No. 6,085,485 to a "Load Bearing Pre-Fabricated Building Construction Panel" both disclose building panels that have a generally Z-shape to their transverse cross-sections but require either an interlocking relationship or an overlapping securing relationship with adjacent modules, and neither teaches or suggests the addition of metallic plates positioned between their front and back panel elements. Also, with the configurations disclosed in both these two patents, when one panel is positioned edge-to-edge between two neighboring panels, it cannot be removed by a simple translation of the panel in a direction perpendicular to a face of the panel. U.S. Pat. No. 6,061,987 to "Sheet Panels for Easy to Assemble Structures" and U.S. Pat. No. 6,658,808 both disclose interlocking building modules that when assembled in an edgewise relationship lock together which unfortunately prevents removal of a damaged intermediate module by simply translating the damaged panel in a direction perpendicular to the face of the panel without disturbing the neighboring panel modules. What is needed for sheltering troops and equipment from ballistic projectile and mortar attacks is a panel designed to be quickly and easily repaired by removal of just the damaged one or more modules and without disturbing the neighboring, undamaged panel modules.

Within the prior art of the related field of armor for protection against high-speed ballistic projectiles, laminates of different materials have been used that consist of bonded-together layers of various materials such as ceramics, woven fabrics, composites, non-metals, and high-strength metals. Examples of these disclosures include U.S. Pat. Nos. 4,198,454; 4,550,044; 4,566,237; 4,822,657; 4,948,673; 4,965,138; 5,326,606; and 5,763,813. But none of these are ideally designed to protect against mortar shells that travel at lower speeds and may have higher explosive energies. Furthermore, none of these patents teach or suggest the design or use of modules from which to construct a panel. New and improved armor-providing building modules are needed in order to be low-cost, practical in their manufacturing and deployment, and effective against modern weapons.

U.S. Pat. No. 5,214,235 to a "Shock Destruction Armor System" teaches the use of multiple spaced-apart metal plates by which to break up and destroy the force of impact of a projectile by shock hydrodynamics. It disclosed an armor system particularly adapted for use on various military vehicles to destroy a long rod penetrator or shaped-charged jet by the principle of shock hydrodynamics. It does not teach or suggest armor-providing building modules, and particularly not their structure, and this is generally the case with the prior art in armor design such as found in the following: U.S. Pat. Nos. 3,962,976; 4,036,104; 4,108,072; 4,355,562; 5,114,772; 5,149,910; 5,221,807; 5,654,518; 5,723,201; 5,792,974; 5,847,308; 6,009,789; 6,021,703; 6,047,626; 6,216,579; 6,345,563; 6,497,966; 6,619,181; 6,642,159; 6,698,331; 6,793,291; and US Pat. Application Numbers 2001/0032541; 2004/0083880; 2004/0159228; 2004/0197542; 2004/0237763.

Thus, a need exists for a better armor-providing building module. In addition, armor-providing building modules need to be low cost to manufacture, to transport, to setup and install, to repair, and to remove.

BRIEF SUMMARY OF THE INVENTION

The invention is pointed out with particularity in the appended claims. However, at least some important aspects of the invention are summarized herein.

A first embodiment of the invention is an armored building module for placement adjacent to similar armored building modules, comprising: a) a first plate having two ends spaced apart longitudinally in a first direction and having two sides spaced apart transversely in a second or sideways direction; b) a second plate having two ends spaced apart longitudinally in said first direction and having two sides spaced apart transversely in said second direction, wherein said second plate is parallel to said first plate and spaced apart from said first plate in a third direction that is perpendicular to both the first and second directions; and c) a first side member and a second side member spaced apart from one another in said second direction and each having two ends spaced apart in said first direction, wherein each of the first and second side members is attached to both said first plate and said second plate; wherein said first and second side members comprise two opposite sides of said armored building module in said second direction; wherein the ends of said first and second plates comprise two opposite ends of said armored building module; wherein a portion of said first plate comprises a first side lap overhang that extends parallel to said second direction, away from the first and second side members, and beyond a nearer of the sides of said second plate; and wherein a portion of said second plate comprises a second side lap overhang that extends parallel to said second direction, away from the first and second side members, and beyond a nearer of the sides of said first plate; whereby said armored building module can be placed side-by-side adjacent to said similar armored building modules thereby forming an armored building panel useful for providing complementary overlapping of their respective side lap overhangs for protection that is continuous from module to module against penetration of explosion debris from mortar shells, and permitting removal and replacement of said armored building module from said armored building panel without requiring the moving of the adjacent similar armored building modules.

According to aspects of the invention, this first embodiment of an armored building module can further comprise: a) a first end lap overhang that is an end extension of said first plate parallel to said first direction; and b) a second end lap overhang that is an end extension of said second plate parallel to said first direction but opposite in direction to the extension of said first plate; whereby said armored building module can be placed end-to-end adjacent to said similar armored building modules providing complementary overlapping of said end lap overhangs for protection that is continuous from module to module.

According to aspects of the invention, this first embodiment of an armored building module can be made a second embodiment by further comprising: a) a first inner flange attached to the first and second side members; and b) a second inner flange attached to the first and second side members; wherein the first and second inner flanges are co-parallel to said first plate, are spaced apart in said third direction from one another and from said first and second plates, and are situated between said first and second plates, wherein said first inner flange is closer to said first plate than is said second inner flange; wherein said first inner flange comprises a portion of said first side lap overhang; and wherein said second inner flange comprises a portion of said second side lap overhang.

According to aspects of the invention, this second embodiment of an armored building module can further comprise: a) a first end lap overhang that is an end extension of said first plate and said first inner flange both parallel to said first direction; and b) a second end lap overhang that is an end extension of said second plate and said second inner flange both parallel to said first direction but opposite in direction to the end extension of said first plate and of said first inner flange; whereby said armored building module can be placed end-to-end adjacent to said similar armored building modules providing complementary overlapping of said end lap overhangs for protection that is continuous from module to module.

According to aspects of the invention, plates and side members of armored building modules can be made of steel, and the structural of parallel plates connected by side members can be manufactured as an integrated structure by an extrusion process. Furthermore, the spaced apart parallel plates can be interleaved with an energy absorbing means for absorbing projectile and blast energy. The energy absorbing means can comprise an energy absorbing material or a combination of energy absorbing materials, and such energy absorbing material can be structured material.

According to aspects of the invention, means of securing (i.e. means of attachment) can be used to secure modules together side-by-side as well as end-to-end.

According to aspects of the invention, an armored building panel for defense as a roof, a floor, a wall, a door, and/or a partition against mortar attacks, comprises: a) a set of longitudinally extended armored building modules each having two opposite sides and arranged side-by-side to form a course of modules, wherein each of the modules abuts another of the modules in a contiguous succession from a first to a last in the set of modules; and wherein each pair of modules that lie adjacent to one-another interface at their sides with complementary and non-mutually-contacting side lap overhangs as viewed in a transverse cross-section; and b) means for securing said armored building modules to one another side-by-side;

wherein the armored building modules are each comprised of a respectively associated set of longitudinally extended and co-parallel plates that are interposed between two side members that support the associated plates along the sides of the plates, wherein each of the plates has two opposite co-parallel faces, and wherein each of the plates is spaced apart from the other plates in the module in a direction perpendicular to said faces of the module; and wherein each of said side members has a Z-shape that conforms with some of the plates of its associated module extending farther toward that side member than the other plates.

The invention also includes a reversible method of removing a selected armored building module from its position in an armored building panel, comprising the steps of: a) providing a panel constructed of a course of armored building modules, wherein each of the modules is elongated between two opposite ends, has two opposite Z-shaped sides each of which includes a side lap overhang, and has two outwardly facing opposite faces, and wherein the panel has two faces comprised respectively of the opposite faces of each of the modules, has two sides each comprised of a side of a module, and has two ends each respectively comprised of ends of the modules; b) choosing the selected module to be removed from the panel; c) translating the selected module in a first direction perpendicular to a face of the selected module a distance sufficient to clear a first side lap overhang of selected module relative to a first face of the panel; d) translating the selected module a second direction toward a side of the panel toward which said first side lap overhang extends; and e) translating the selected module in said first direction a distance sufficient to clear the entire selected module from the panel; whereby said armored building panel can be replaced by removing only selected modules without having to move others of the modules in the panel.

OBJECTS AND ADVANTAGES OF THE INVENTION

Objects and advantages of the present invention include:

a) to provide low-cost, low-relative-weight, armored building modules and armored building panels, both capable of withstanding and protecting against mortar projectiles and mortar blasts;

b) to provide armored building modules and armored building panels, both capable of use as load-bearing structural components in walls, floors, ceilings, and roofs;

c) to provide an armored building module long enough, wide enough, and deep enough to prevent a motor shell from entirely disabling its ability to withstand its longitudinal and transverse loading;

d) to provide an armored building module with enough remaining strength after sustaining damage from a mortar shell to support itself, and to simultaneously provide an armored building module capable of supporting any load increase due to presence of damaged modules;

e) to provide armored building modules having a structure means that enables the incorporation of commonly available steel plate and steel sheet materials to comprise their structure;

a) to provide armored building panels constructed using armored building modules that are comprised of multiple steel plates, each adjacent pair of plates separated from one another by a region of air or other energy-absorbing means that has greater thickness than either of the pair of plates individually;

a) to provide an armored building module constructed with welds between flat steel plates and formed steel plates (or steel sheets);

a) to provide armored building panels that are comprised of armored building modules that are designed to overlap at their edges and at their ends and to be easily interconnected to one another edge-to-edge and end-to-end;

a) to provide armored building modules which include means for securing adjacent modules edge-to-edge and end-to-end;

a) to provide armored building modules with means for securing that won't interfere with standard roof-covering materials such as a water-proof membrane;

a) to provide a means for sealing which enables strips of sealing material to be located and squeezed between adjacent armored building modules edge-to-edge and end-to-end;

a) to provide a replacement means for replacing armored building modules within an armored building panel by removal of damaged modules and substitution with undamaged modules, wherein removal and substitution are each accomplished by a simple sequence comprising translations perpendicular to an external face, translations parallel to the external face, and a final translation perpendicular to the external face, without disturbing adjacent undamaged modules.

Further advantages of the present invention will become apparent to the ones skilled in the art upon examination of the drawings and detailed description. It is intended that any additional advantages be incorporated herein.

The disclosed structures of panels comprised of modules with two outer plates and no inner flanges have been tested and proven successful as protection against 81 mm mortar blasts and shrapnel; whereas the disclosed structures of panels comprised of modules with two outer plates and two inner flanges have been tested and proven successful as protection against 120 mm mortar blasts and shrapnel.

The various features of the present invention and its preferred implementations may be better understood by referring to the following discussion and the accompanying drawings. The contents of the following discussion and the drawings are set forth as examples only and should not be understood to represent limitations upon the scope of the present invention.

BRIEF DESCRIPTION OF THE SEVERAL VIEWS OF THE DRAWINGS

The foregoing objects and advantages of the present invention for armored building modules, and of armored building panels constructed from assemblies of these armored building modules, may be more readily understood by one skilled in the art with reference being had to the following detailed description of several embodiments thereof, taken in conjunction with the accompanying drawings. Within these drawings, like reference numerals refer to like elements in the several figures, with the exception that letter-suffixes and primes each signify elements having additional or altered features, and in which:

FIG. 13A shows an end view of a version of armored building panel consisting of only three armored building modules of the modified second embodiment without end members, these modules modified to incorporate side means for securing modules to one-another (e.g. side tabs) and fastening means for module-to-module securing (e.g. bolts and nuts).

FIG. 13B shows an end view of a single armored building module of the modified second embodiment without end closures or end means for securing modules to one another (e.g. end tabs), but complete with side means for securing modules to one-another (e.g. side tabs). The largest distance between sides of the module is significantly larger than the distance between the outermost of four parallel plates (or flanges) which are front and back plates.

FIG. 13C is an end view showing an armored building module comprised of two outer plates and only one inner flange.

FIG. 13D is an end view showing an armored building module exhibiting alternatives to how outer plates, inner flanges, and side members can be configured and inter-related.

FIG. 14A shows an end view of a single armored building module comprising five or more armored building modules of the modified second embodiment, these modules modified to incorporate side means for securing modules to one-another (e.g. side tabs), fastening means for module-to-module securing (e.g. bolts and nuts), and end means for securing modules to one-another (e.g. end tabs). FIG. 14A also shows a means for sealing (e.g. a gasket) placed within each region of contact between sideways adjacent modules, i.e. at the sides of modules where they are overhanging the adjacent module.

FIG. 14B shows a perspective view of a single armored building panel consisting in this example of five armored building modules of the modified second embodiment, the modules modified the same as shown in the previous FIG. 14A but here also showing lifting devices incorporated on the viewable face of each module.

LIST OF REFERENCE NUMERALS USED IN THE DRAWINGS

Figure 1:
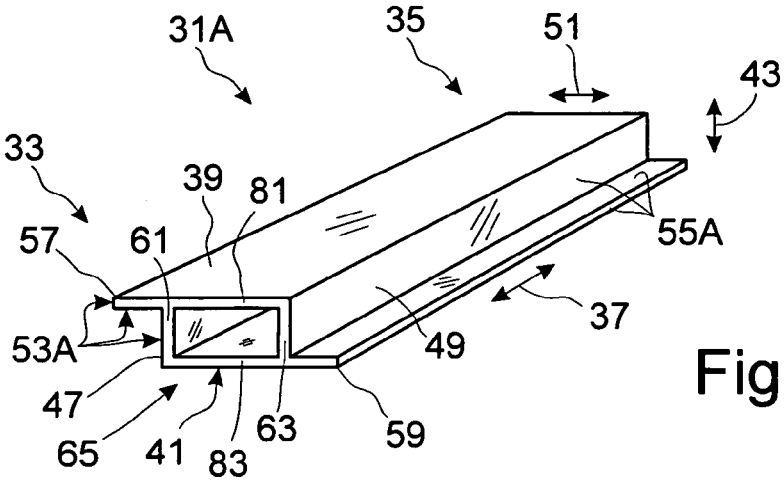
FIG. 1 shows a perspective view of a first embodiment of an armored building module.

Excluding the Versions of these Numerals Having Letter-Suffixes and/or Primes to Signify Elements Having Additional or Altered Features The following reference numerals are used in the drawings and in the description of the invention:

| | |
|---|---|
| 31 | armored building module (alias: module) |
| 33 | first longitudinal end |
| 35 | second longitudinal end |
| 37 | longitudinal directions (includes: first direction) |
| 39 | first face |
| 41 | second face |
| 43 | facing directions (includes: third direction) |
| 47 | first side member |
| 49 | second side member |
| 51 | sideways directions (includes: second direction) |
| 53 | first Z-shaped side |
| 55 | second Z-shaped side |
| 57 | first side lap overhang |
| 59 | second side lap overhang |
| 61 | first web |
| 63 | second web |
| 65 | first cavity |
| 66 | first side flange |
| 67 | first overhang web |
| 68 | second side flange |
| 69 | second overhang web |
| 71 | first side means for securing modules to one-another (e.g. a side tab) |
| 73 | second side means for securing modules to one-another (e.g. a side tab) |
| 75 | hole |
| 77 | end clearance in side tab |
| 81 | first plate (alias: first outside flange) |
| 83 | second plate (alias: second outside flange) |
| 85 | first inner flange |
| 87 | second inner flange |
| 89 | second cavity |
| 91 | third cavity |
| 93 | first end lap overhang |
| 95 | second end lap overhang |
| 97 | first means for closing an end of a cavity |
| 99 | second means for closing ends of cavities |
| 111 | first end means for securing modules to one-another (e.g. an end tab) |
| 113 | second end means for securing modules to one-another (e.g. an end tab) |
| 115 | side clearance in end tab |
| 117 | energy absorbing means for absorbing projectile and blast energy |
| 118 | pocket end cap |
| 119 | two armored building modules assembled side-by-side and including a pair of pocket end caps |
| 120 | armored building panel with three armored building modules assembled side-by-side |
| 121 | lap-joint-formed pocket (alias: inter-module cavity) |
| 123 | first Z-shaped end element |
| 125 | second Z-shaped end element |

-continued

| | |
|---|---|
| 127 | fastening means for module-to-module securing (e.g. a bolt and a nut) |
| 129 | wider module |
| 131 | armored building panel (alias: panel) |
| 133 | means for sealing (e.g. a gasket) |
| 135 | example of an armored building panel |
| 137 | lifting means for lifting a module or panel (e.g. steel ring) |
| 139 | roof |
| 141 | first course of modules |
| 143 | second course of modules |
| 145 | stringer |
| 147 | support column |
| 149 | armored building module for removal or replacement |
| 151 | end view after first faceways translation |
| 153 | end view after sideways translation |
| 155 | side view after sideways translation |
| 157 | side view after endways translation |
| 159 | end view after second faceways translation |

DETAILED DESCRIPTION OF THE INVENTION

The following is a detailed description of the invention and its preferred embodiments as illustrated in the drawings. While the invention will be described in connection with these drawings, there is no intent to limit it to the embodiment or embodiments disclosed. On the contrary, the intent is to cover all alternatives, modifications and equivalents included within the spirit and scope of the invention as defined by the appended claims.

About defined directions used in describing the modules and panels of the current invention in this disclosure: armored building modules are disclosed that have a predominately longitudinal shape along bi-directional longitudinal directions, have front and back faces along bi-directional facing directions, and have opposite sides spaced apart along bi-directional sideways directions. The sideways directions are perpendicular to the facing directions, and both are perpendicular to the longitudinal directions. The sideways directions and the facing directions are therefore both transverse to the longitudinal directions. And "transverse cross-section" is used to mean a cross-section taken perpendicular to the longitudinal directions.

A word about "means for securing" and "means for joining" as used in this disclosure: the phrases "means for securing" and "means for joining" are for all intent and purposes synonymous since securing and joining are both operations for connecting one element to another. Throughout this disclosure, "means for securing" is used when describing ways to fasten one structure to another, such as by using bolts with nuts through holes in both structures, by using clamping devices grasping elements of both structures, and all equivalents to fastening two elements together that are known to one experienced in the art of fasteners. The phrase "means for joining" is used throughout this disclosure when describing ways to connect elements of a module together, such as by extrusion, by welding (such as continuous seam welding, spot welding, tack welding), screwing, interlocking, and by other fastening techniques known to those skilled in the art of joining materials together at a mutual interface.

FIG. 1 shows a perspective view of a first embodiment of an armored building module 31A. The module 31A has a first longitudinal end 33 and a second longitudinal end 35 spaced apart along longitudinal directions 37. The module 31A therefore has a generally elongated shape extending along the longitudinal directions 37. This first embodiment of an armored building module 31A is comprised of a first plate 81 and a second plate 83 interconnected by a first side member 47 and a second side member 49. The first plate 81 has a first face 39 perpendicular to facing directions 43, while the second plate 83 has a second face 41 perpendicular to facing directions 43, both faces 39,41 facing outward or away from one another. The facing directions 43 are perpendicular to the longitudinal directions 37. The first and second side members 47,49 are spaced apart in sideways directions 51 that are perpendicular to both the longitudinal directions 37 and the facing directions 43. The first plate 81 includes a first side lap overhang 57 extending sideways beyond the first side member 47, and wherein the second plate 83 includes a second side lap overhang 59 extending sideways beyond the second side member 49. This module 31A exhibits a beam structure wherein the first plate 81 can function as a first outside flange, the second plate 83 can function as a second outside flange, the first side member 47 can function as a first web 61, and the second side member 49 can serve as a second web 63. Note that a first cavity 65 is defined by the space between the two plates 81,83 and the two side members 47,49. Also note that the module 31A can be said to have two Z-shaped sides 53A and 55A since its sides 53A,55A include not only the side members 47,49 but also edges (at least one per side) of the plates 81,83. Each of the sides 53A and 55A of the module therefore define a Z-shape since they include two surfaces of one of the overhangs 57 and 59, as well as one of the side members 47,49 (consistent with a Z-shape having three edges).

Thus the module 31A shown in FIG. 1 functions well as an armored building module. Constructed of strong material such as steel, its elongated structure comprising multiple (equally elongated) flanges 81,83 and webs 61,63 provide it with ample strength as a structural element and component in floors, walls, doors, partitions, and especially roofs. The composition of two separated plates 81,83 supported by two separated webs 61,63 can protect people and equipment from impacts, blasts, ballistics, and shrapnel when these threats strike one of the faces 39,41 facing outward from the protected space. All of the modules and panels made from the modules of this invention, including the first embodiment of an armored building module 31A as shown in FIG. 1, are designed especially to withstand and structurally survive impacts, blasts, and shrapnel from mortars. One skilled in the art will appreciate that the use of high strength steels or lighter weight, high-strength aluminum or titanium material in any of the armored building modules and armored building panels of this invention can provide greater protection for building occupants and equipment than will common steel materials, but the ultimate choices of materials may depend upon customer defined constraints anticipated threat levels, weight and cost.

As shown in FIG. 1, the features of armored building module embodiment 31A which especially address challenges from mortars include a) multiple plates spaced apart between a protected and an unprotected space (i.e. spaced apart in the facing directions 43, b) multiple and spaced-apart plates whose separation is supported by spaced-apart webs, and c) side lap overhangs 57,59 that permit side-by-side alignment and overlap with adjacent modules to construct a panel that has no straight-through seams between modules through which a mortar (or its blast or shrapnel) can penetrate. Also addressing threats from mortar attacks, as will be described below with reference to FIGS. 15A through 15F, addressing a need for rapidly repairing damaged panels, the particular configuration of modules of the current invention (e.g. 31A) have lap overhangs (e.g. 57,59) that enable individual modules to be removed from a panel and replaced into the panel without having to move adjacent modules comprising the panel.

In the current invention, the plates 81,83 and side members 47,49 shown in FIG. 1 can be the integrated result of an extrusion, or they can be the result of securing separate elements together, preferably by welding. One skilled in the art of fabricating steel beams will recognize that one alternative for constructing the shape shown in FIG. 1 is to weld two T-beams together.

Preferred dimensions of the armored building module of FIG. 1 are a length of approximately 3.05 meters (10 feet), a side-to-side width (including the lap overhangs 57,59) of approximately 76.2 centimeters (30 inches), and a depth between faces 39,41 of approximately 16.5 centimeters (6.5 inches), wherein the amount of overhang of each lap overhang 57,59 is approximately 15.2 centimeters (6 inches). A preferred dimension for the thickness of the elements (plates 81,83, side members 47,49, and side lap overhangs 57,59) is approximately 6.3 millimeters (0.25 inch). One skilled in the art can readily appreciate that other dimensions are preferred depending upon design requirements of a customer, needs of a builder, and/or supplies of materials that may be readily available. One skilled in the art can also readily appreciate that the thickness of the various elements need not all be the same; for example, the thickness of one of the plates 81 or 83 may be chosen to be thicker than the other one where that other one is intended to be the first to blunt an initial impact from a mortar shell and serve as a sacrificial layer to the mortar's explosive blast. In that case, the thicker plate 81 or 83 is the one that must finally stop any shrapnel and blast energy that penetrates the thinner plate. An advantage of a thinner plate being struck first by an incoming mortar shell is that it can absorb kinetic energy by bending into the space 65 separating the thinner and thicker plates 81,83.

Figure 2A:
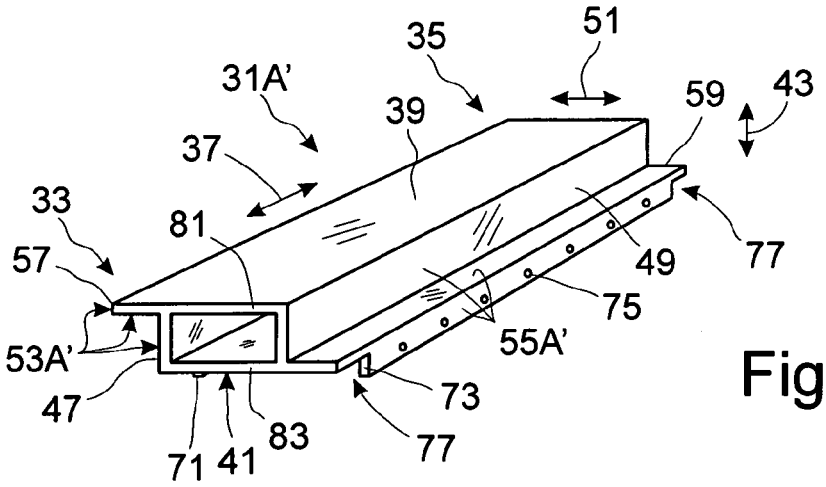
FIGS. 2A and 2B show two different perspective views of a modified first embodiment of an armored building module having included side means for securing modules to one-another.
Figure 2B:
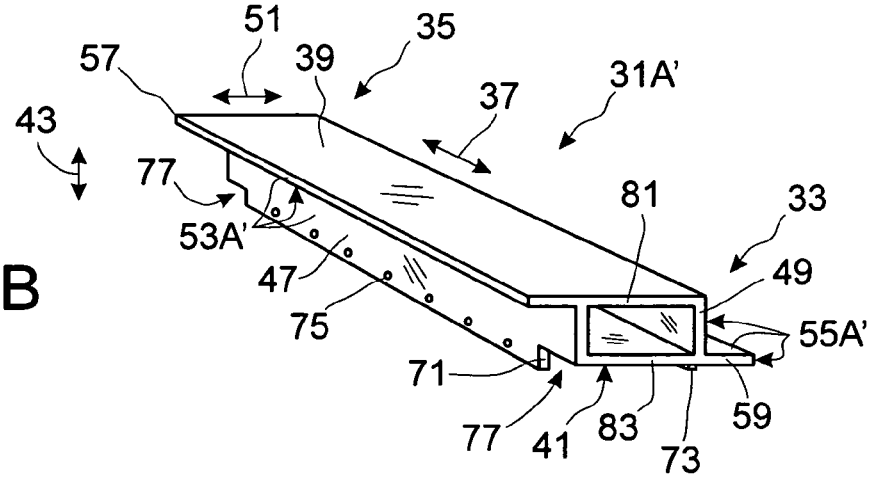

FIGS. 2A and 2B show two different perspective views of a modified first embodiment 31A' of an armored building module having included a first and second side means 71,73 for securing modules to one-another. Extending outward and parallel to the facing directions 43 are tab-like structures 71,73 having holes such as hole 75. These tab-like extensions 71,73 permit the module 31A' to be secured to another similar module (not shown) using to fastening means (not shown) for module-to-module securing, such as bolts and nuts located through the holes (such as hole 75). Note that in this example of a modified first embodiment 31A', the first side means 71 is located as an extension from first side member 47, whereas the second side means 73 is located as an extension from the second side lap overhang 59. In other words, the side means 71,73 appear as tab extensions outward from the Z-shaped sides 53A' and 55A', extending below the face 41 of plate 83 parallel to the facing directions 43. End clearances 77 in the side means 71,73 allow the module 31A' to be supported at the ends 33,35 without the side means 71,73 interfering mechanically with a supporting means (not shown) for supporting the module at its ends 33,35. An example of supporting means for supporting a module at its ends 33,35 is shown as stringers 145 in FIG. 14.

Figure 3:
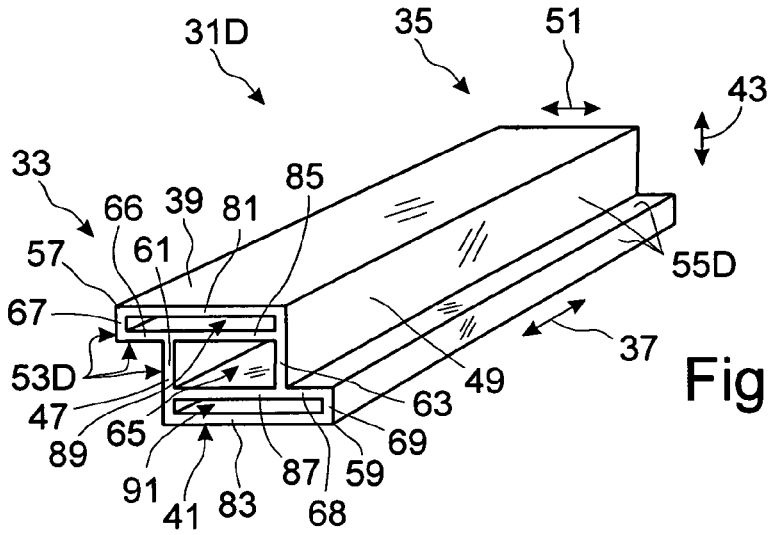
FIG. 3 shows a perspective view of a second embodiment of an armored building module.

FIG. 3 shows a perspective view of a second embodiment 31D of an armored building module that is an enhancement of the first embodiment 31A. This second embodiment or module 31D also has two longitudinal ends 33,35 that are spaced apart along longitudinal directions 37. The module 31D therefore also has a generally elongated shape extending along the longitudinal directions 37. This second embodiment of an armored building module 31D, like the first embodiment 31A in FIG. 1, is comprised of a first plate 81 and a second plate 83, wherein the first plate 81 has a first face 39 facing outward parallel to the facing directions 43, and wherein the second plate 83 has a second face 41 facing outward in the opposite direction parallel to the facing directions 43. The facing directions 43 are perpendicular to the longitudinal directions 37. Unlike the first embodiment 31A, this second embodiment 31D is also comprised of a first inner flange 85 and a second inner flange 87. The pair of inner flanges 85,87 is interposed between the plates 81,83, and each of the pair of inner flanges 85,87 is also perpendicular to facing directions 43. The plates 81,83 and the inner flanges 85,87 are interconnected by a first Z-shaped side 53D and a second Z-shaped side 55D, wherein these Z-shaped sides 53D,55D are spaced apart from one another along sideways directions 51 that are perpendicular to both the longitudinal directions 37 and the facing directions 43. The first plate 81 extends sideways beyond a first side member 47 comprising part of a first side lap overhang 57; the second plate 83 extends sideways beyond a second side member 49 comprising part of a second side lap overhang 59. A first overhang web 67 is connected to a sideways outermost edge of the overhanging portion of the first plate 81; and a second overhang web 69 is connected to a sideways outermost edge of the overhanging portion of the second plate 83. A first side flange 66 is connected to the first overhang web 67; and a second side flange 68 is connected to the second overhang web 69. A first side member 47 interconnects the first side flange 66 with edges of both the second inner flange 87 and the second plate 83; a second side member 49 interconnects the second side flange 68 with edges of both the first inner flange 85 and the first plate 81. The first Z-shaped side 53D includes the first web 61, the first side flange 66, and the overhang web 67; the second Z-shaped side 55D includes the second web 63, the second side flange 68, and the overhang web 69. The first side member 47 includes the first web 61; the second side member 49 includes the second web 63. The mid-leg of each of the Z-shaped sides 53D,55D, i.e. the portion between the respective side member 47 or 49 and the respective overhang web 67 or 69, functions both as part of the respective Z-shaped side 53D or 55D and as an overhanging part of the respective inner flange 85 or 87.

One skilled in the art can appreciate that there are alternative ways to construct the structure shown in FIG. 3, and that all such alternatives produce obvious equivalents to that shown in FIG. 3. For example, the side flanges 66 and 68 may make up the middle portions of Z-shaped sides 53D,55D, and these Z-shaped sides 53D,55D may be attached during manufacture to the set consisting of parallel plates 81,83 and parallel inner flanges 85,87. Or, alternatively, the side flanges 66,68 can be simply extended portions of the inner flanges 85,87 respectively, whereas the overhang webs 67,69 and separate side members 47,49 may be attached during manufacture to the set consisting of parallel plates 81,83 and parallel inner flanges 85,87. Some particular examples of ways by which the sides of a module can be constructed are illustrated and discussed below with respect to FIGS. 12A, 12B, 12C, and 12D. A third alternative, for example, is one where all the parts shown in FIG. 3 are extruded together into a single monolithic beam structure to form this second embodiment 31D of an armored building module.

As shown in FIG. 3, the module 31D exhibits a beam structure wherein the plates 81,83 can function as outside flanges, the inner flanges 85,87 (which may include the side flanges 66,68) can function as additional flanges, the side members 47,49 can function as a webs 61,63, and the overhang webs 67,69 can function as additional webs. Note that a first cavity 65 is created by the space between the two inner flanges 85,87 and the two webs 61,63. A second cavity 89 is created by the space having a rectangular cross-section between the first plate 81, the first inner flange 85, the first overhang web 67, and a portion of the second web 63 (i.e. a portion of the second side member 49). A third cavity 91 is created by the space having a rectangular cross-section between the second plate 83, the second inner flange 87, the second overhang web 69, and a portion of the first web 61 (i.e. a portion of the first side member 47).

The second embodiment 31D of an armored building module, shown in FIG. 3, has an advantage over the first embodiment 31A shown in FIG. 1 since the second embodiment 31D has as additional barriers the inner flanges 85,87 with which to stop the impact, blast, and shrapnel from a mortar threat. The preferred dimensions of a module 31D are essentially the same as those of the module 31A, except for approximately 9.5 centimeters (3.75 inches) additional distance between the first and second plates 81,83, approximately equally divided between the second and third cavities 89,91 including the thickness of their adjacent and respective inner flanges 85,87.

It should be obvious to one skilled in the art that either or both additional inner flanges (similar to inner flanges 85,87) and consequent additional spaces of separation (similar to cavities 65, 89, and 91) can increase the threat resistance and survivability of armored building modules, and it is intended that the current invention cover such equivalents. Also intended to be covered as an obvious equivalent is the case where only one of the inner flanges 85,87 and one of the respective cavities 89,91 are added to the basic structure of the first embodiment 31A, rather than both of each as in the illustrated second embodiment 31D, wherein a module results with only two parallel plates and one inner flange. Also, the thickness and material chosen for each of the plates 81,83, each of the inner flanges 85,87, and each of the Z-shaped sides 55D,57D can each be individually and independently specified. If the Z-shaped sides 53D, 55,D are not integrated whole pieces to begin with, then at least the thickness and material chosen for each of the webs 61,63 and each of the overhang webs 67,69 can be individually and independently specified.

The embodiments 31A and 31D shown respectively in FIGS. 1 and 3 represent core structures of the armored building modules of the current invention. The other figures in this disclosure show armored building modules and armored building panels built using these core structures but embellished with various modifications that close the ends, add overhangs at the ends, link modules together side-by-side or end-to-end, add lifting means for lifting modules of panels, and add energy absorbing means within cavity spaces to absorb projectile and blast energies. After those other figures, the remaining figures show assemblies of modules into panels, the use of modules and panels of those modules to construct an example of a sheltering roof, and finally the reversible sequence by which a module can be removed from a panel without having to move adjacent modules, that due to the unique and novel design of lap overhangs in this invention that don't contact one another when aligned side-by-side or end-to-end.

Figure 4A:
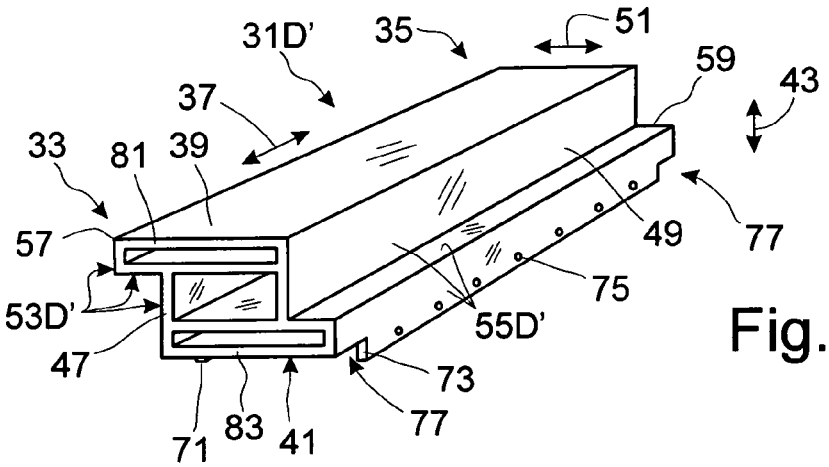
FIGS. 4A and 4B show different perspective views of a modified second embodiment of an armored building module having included side means for securing modules to one-another.
Figure 4B:
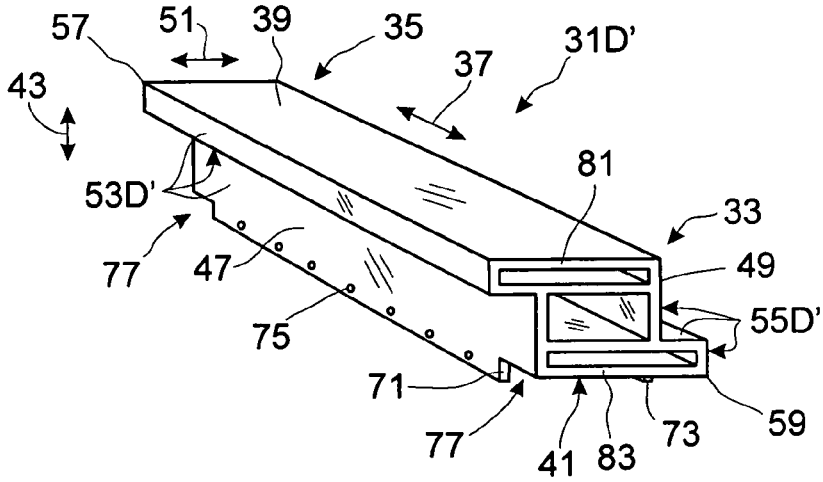

FIGS. 4A and 4B show different perspective views of a modified second embodiment 31D' of an armored building module having additionally included side means 71,73 for securing modules to one-another. The modified Z-shaped sides 53D' and 55D' here have added side means 71,73 for securing modules to one another. What is shown in FIGS. 4A and 4B as examples for these side means 71,73 for securing modules to one-another are tabs 71,73 with holes such as hole 75. As with the modified first embodiment 31A' in FIGS. 2A and 2B, end clearances 77 are shown where the tabs end short of the longitudinal ends 33,35 of the module 31D'. Also, similar to the modified first embodiment 31A' of FIGS. 2A and 2B, the side means 71,73 appear as tab extensions outward from the modified Z-shaped sides 53D' and 55D', extending below the face 41 of plate 83, and extending parallel to the facing directions 43.

Figure 5A:
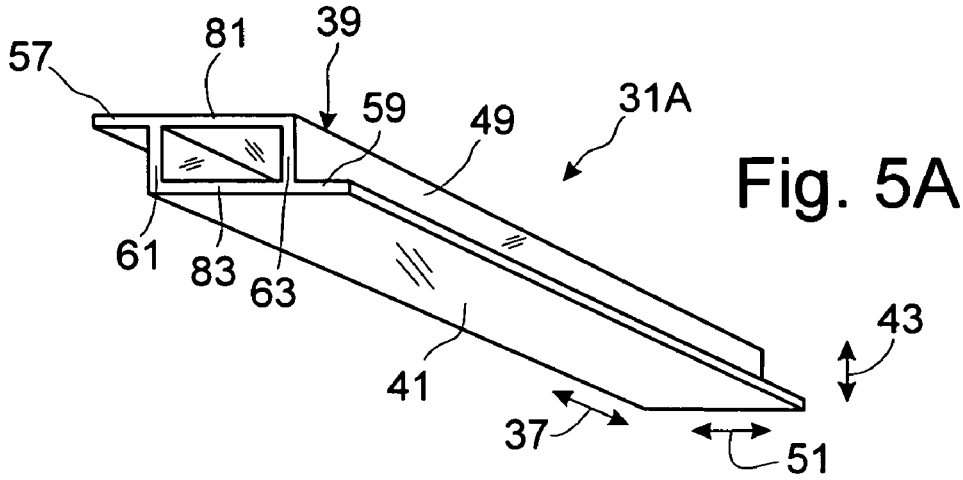
FIG. 5A shows a different perspective view of the first embodiment of an armored building module shown in FIG. 1.
Figure 5B:
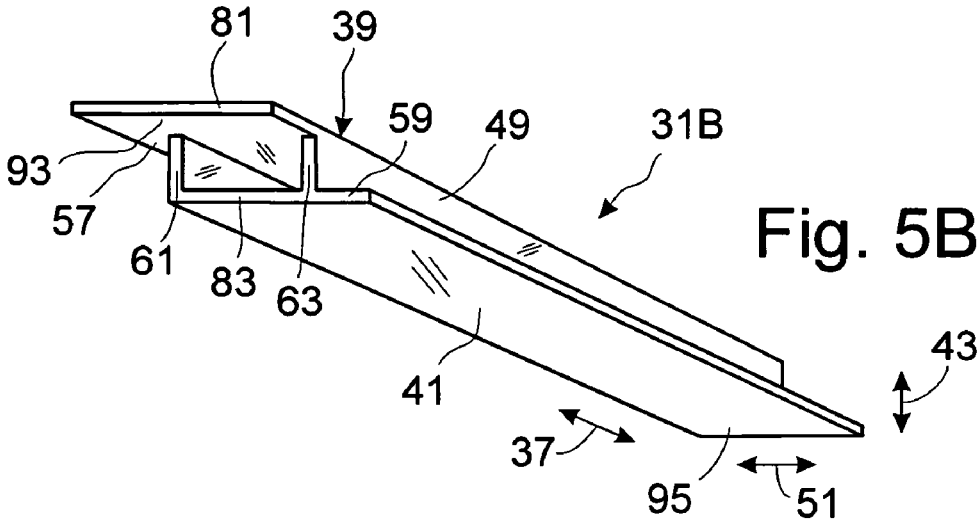
FIGS. 5B and 5C show perspective views of modified versions of the first embodiment of an armored building module, each modified to include an end lap overhang at each end of the module, wherein the orientation sense of the overhangs of the module in one view is the opposite of that in the other view.
Figure 5C:
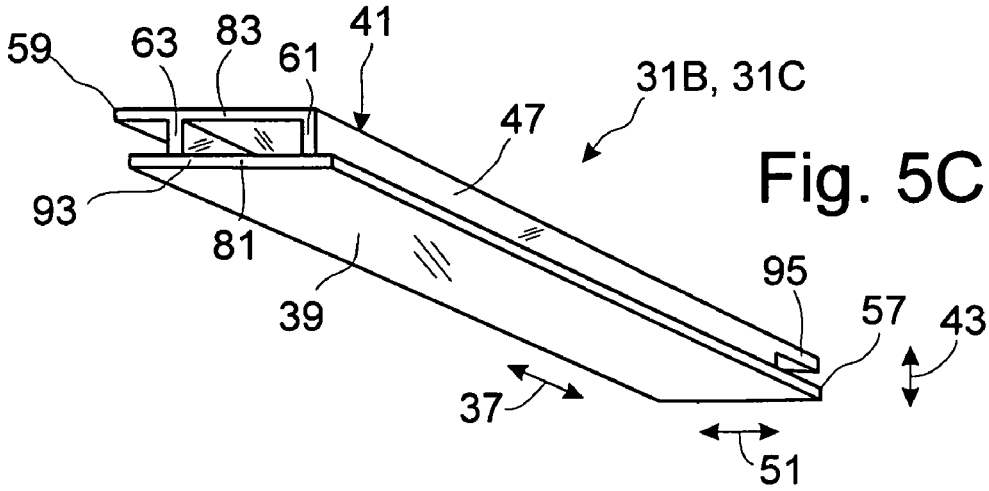

FIG. 5A shows a different perspective view of the first embodiment 31A of an armored building module as shown in FIG. 1. FIG. 5B shows a similar perspective view to that of FIG. 5A, but of modified version 31B of the first embodiment 31A of an armored building module. In FIG. 5B, modified first embodiment 31B is shown with plate 81 extended longitudinally to form a first end lap overhang 93 at the nearer end of the module 31B, and plate 83 extended longitudinally to form a second end lap overhang 95 at the farther end of the module 31B. In FIG. 5C, modified first embodiment 31B is shown again but in a different perspective, having been rotated about the longitudinal axis 180 degrees from the orientation shown in FIG. 5B. In FIG. 5C, the module 31B is also given another label 31C for referencing convenience in describing a modified 31C' version later that adds side means for securing that enables it to be differentiated by a unique orientation-handedness or sense to its resulting configuration 31C' in FIG. 6C versus 31B' in FIG. 6B.

In FIGS. 5B and 5C, the end lap overhangs 93,95 permit module 31B to be nested end-to-end with adjacent modules of similar design such that an end lap overhang of one module overlaps an end lap overhang of another module when those two modules are aligned end-to-end. This is according to the present invention that uses such overlapping of overhangs to enable the interfaces between modules to stop mortar shells, blasts, and shrapnel from penetrating through the interfaces between modules.

Figure 6A:
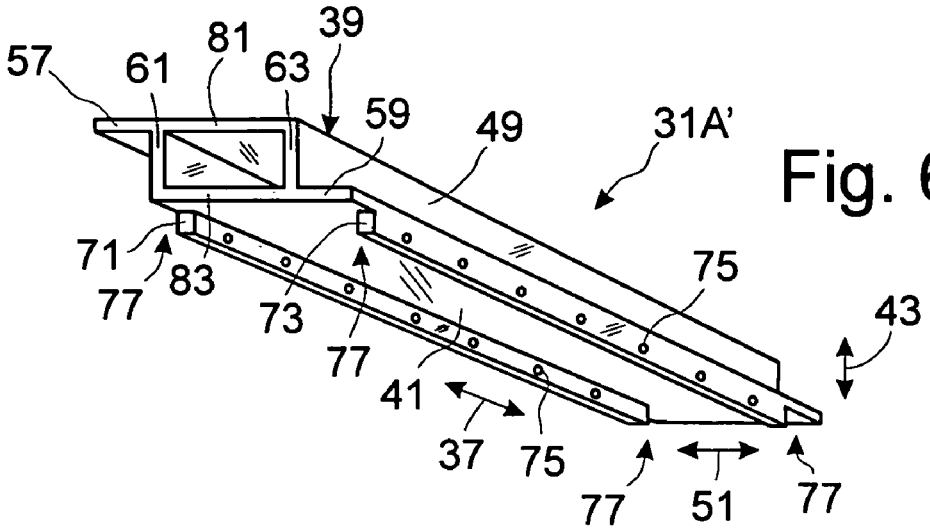
FIGS. 6A, 6B, and 6C show modified versions of the armored building modules shown respectively in FIGS. 5A, 5B, and 5C wherein the modifications included are tab-like features extending downward in the views and from the sides of the modules. These tab-like features and their included holes provide side means for securing the module to other modules.
Figure 6B:
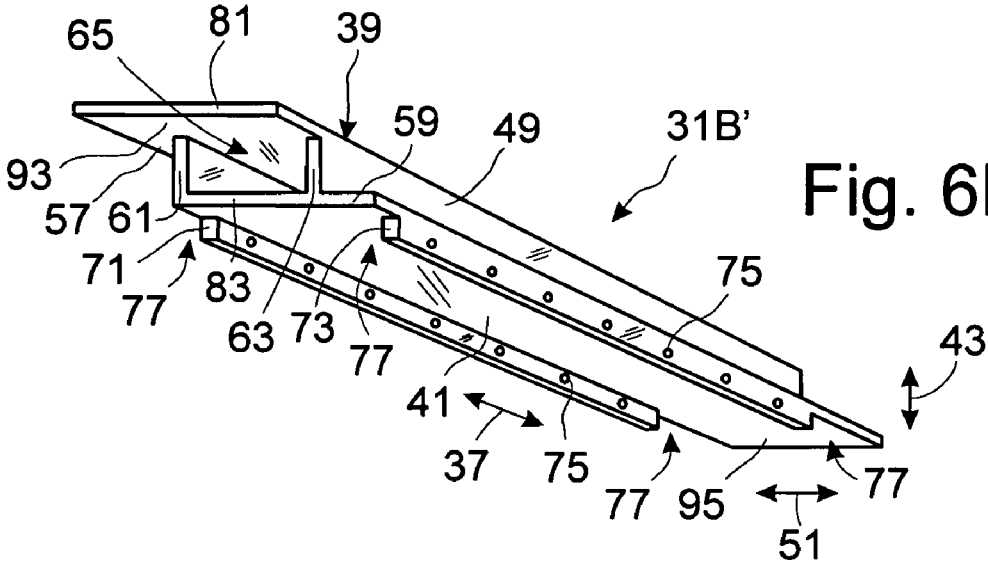
Figure 6C:
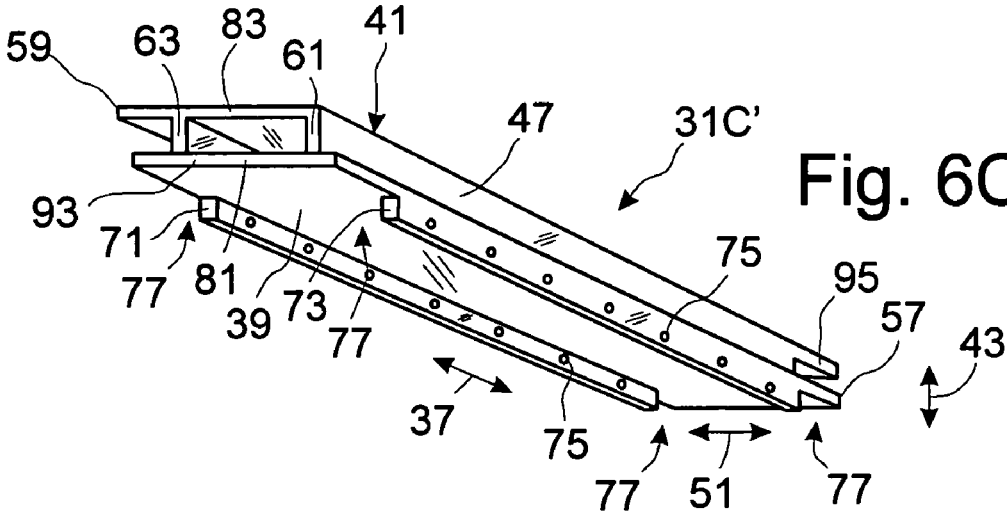

FIGS. 6A, 6B, and 6C show perspective views of modified versions 31A', 31B', and 31C' of the first embodiment of armored building modules 31A, 31B, and 31C shown respectively in FIGS. 5A, 5B, and 5C, wherein the modifications included are tab-like features 71,73 extending downward in the views (parallel to the facing directions 43) and from sides of the modules (i.e. from opposite sides of one of the plates 81,83). FIG. 6A shows a different perspective view of the modified first embodiment 31A' shown in FIGS. 2B and 2C. The perspective of views shown in FIGS. 6B and 6C are similar to that of FIG. 6A. Note that the modules 31B' and 31C' appearing in FIGS. 6B and 6C have added first and second end lap overhangs 93,95 in opposite of the longitudinal directions 37 one module from the other, but have side lap overhangs 57,59 extending toward the same of the sideways directions 51 one module from the other. The tab-like features 71,73 and their included holes 75 provide side means 71,73 for securing the modules 31A', 31B', and 31C' to other modules in side-by-side alignments. End clearances 77 in side tabs 71,73 are shown in each of FIGS. 6A, 6B, and 6C. Whereas modules 31B and 31C shown in FIGS. 5B and 5C are merely rotated versions of one another, adding to sides of only one of the plates 81 and 83 side means 71,73 for securing modules to one another produces modified modules 31B' and 31C', shown in FIGS. 6B and 6C, which are no longer simply rotated versions of the same module.

Figure 7A:
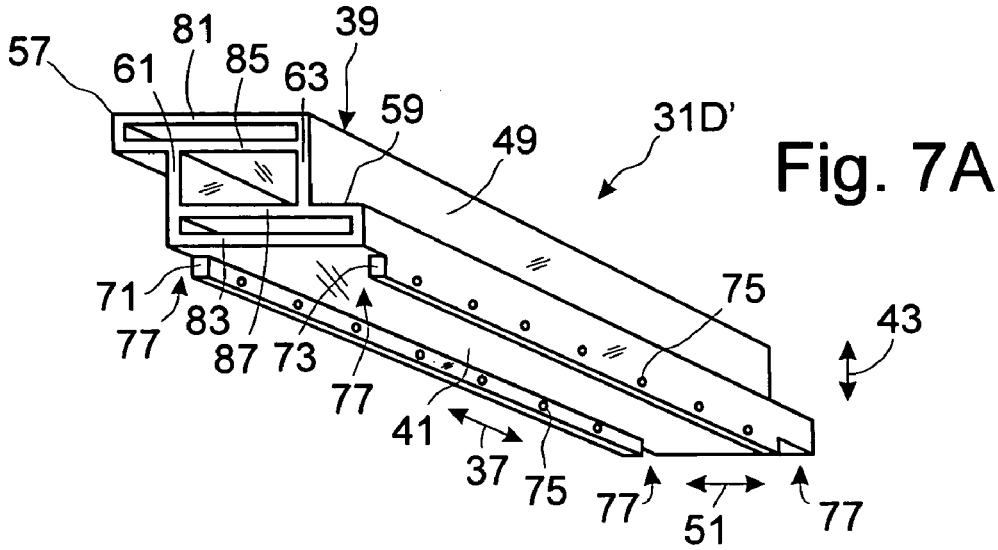
FIG. 7A shows a different perspective view of the modified second embodiment of an armored building module shown in FIGS. 4A and 4B.
Figure 7B:
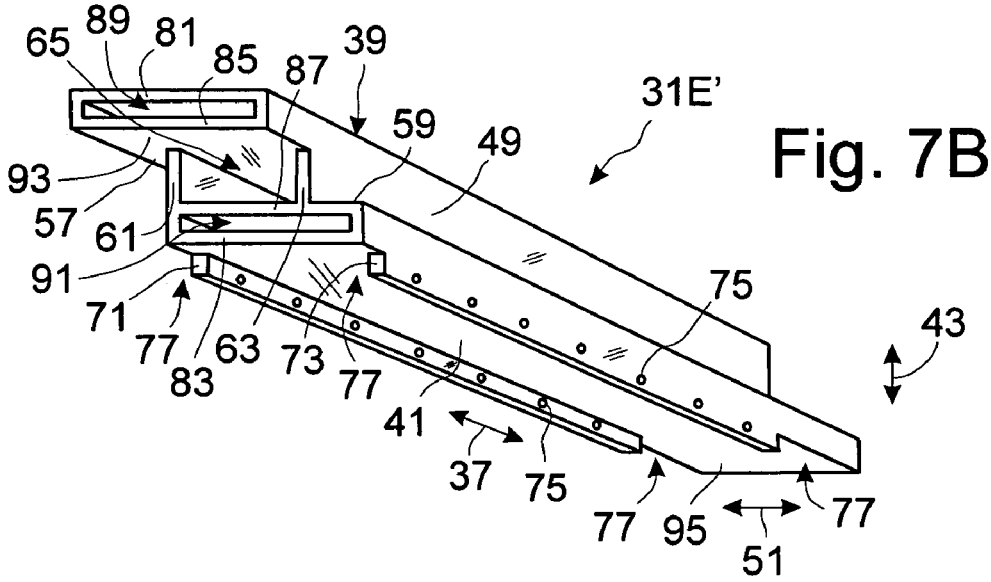
FIGS. 7B and 7C show perspective views of again modified versions of the modified second embodiment of an armored building module shown in FIG. 7A, each modified to include an end lap overhang at each end of the module, wherein the orientation sense of the overhangs of the module in one view is the opposite of that in the other view.
Figure 7C:
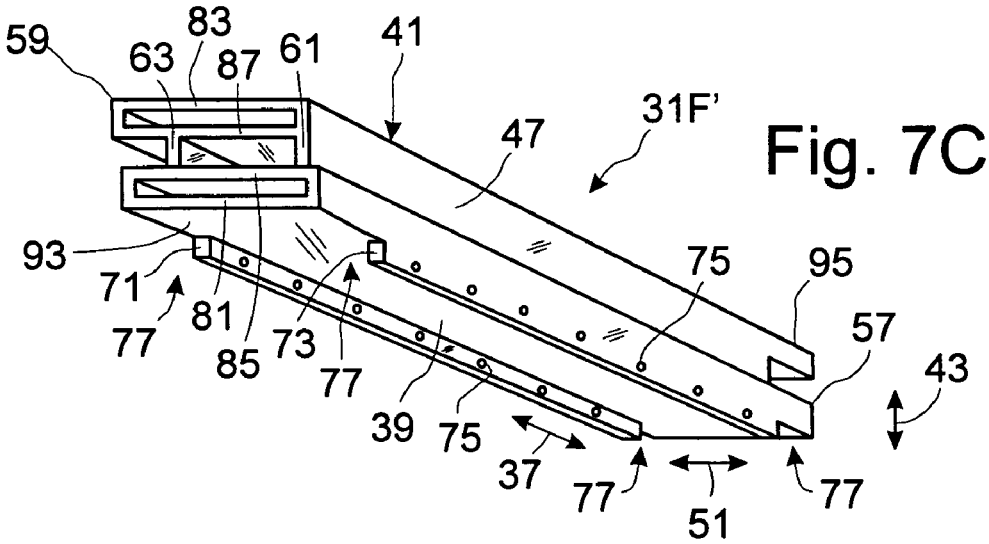

FIG. 7A shows a different perspective view of the modified second embodiment 31D' of an armored building module shown in FIGS. 4A and 4B. FIGS. 7B and 7C show similar perspective views of again modified versions 31E' and 31F' of the modified second embodiment of an armored building module shown in FIG. 7A, each 31E',31F' modified to include an end lap overhang at each end of the module, wherein the orientation sense of the overhangs of the module in one view is the opposite of that in the other view.

Figure 8A:
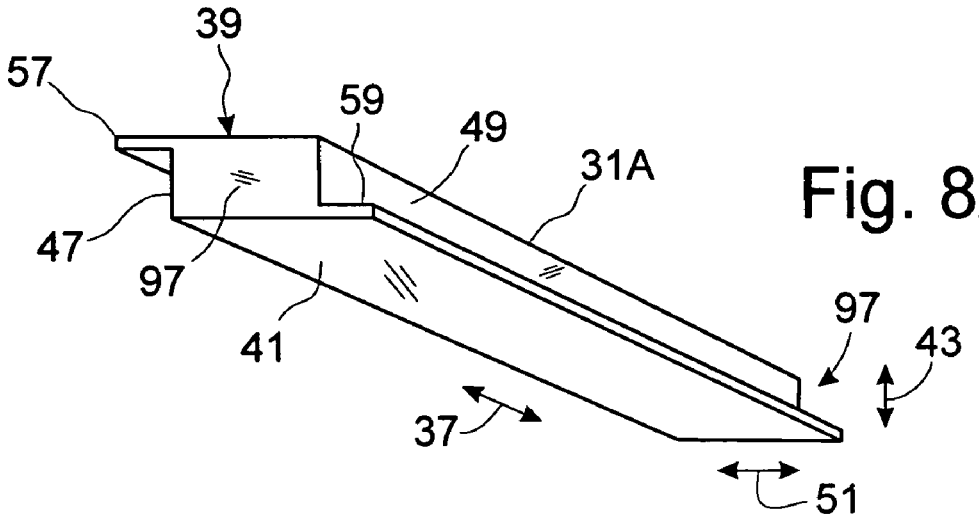
FIGS. 8A, 8B, and 8C show perspective views of modified versions of the armored building modules shown in FIGS. 1A, 6B, and 7B respectively, wherein the otherwise open ends of channels formed between the component plates and side members have been closed off by the incorporation of end members.
Figure 8B:
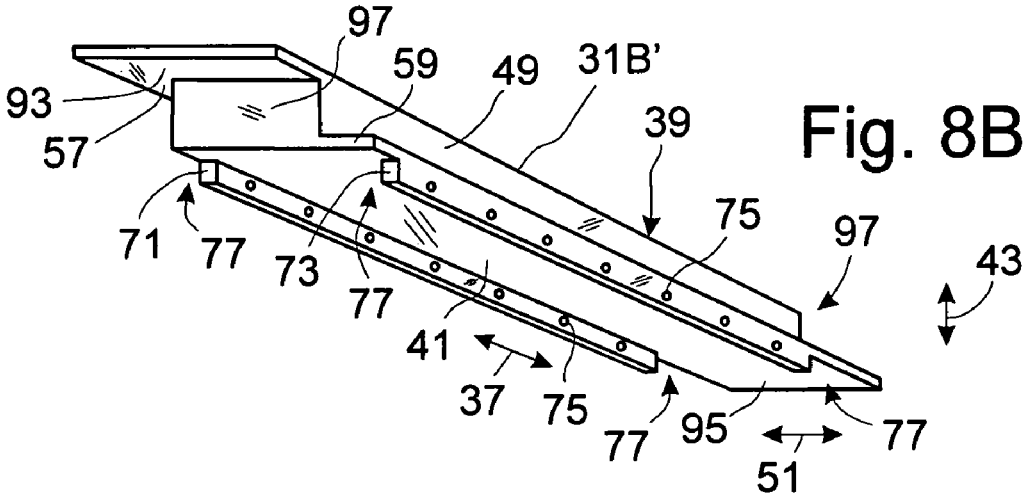
Figure 8C:
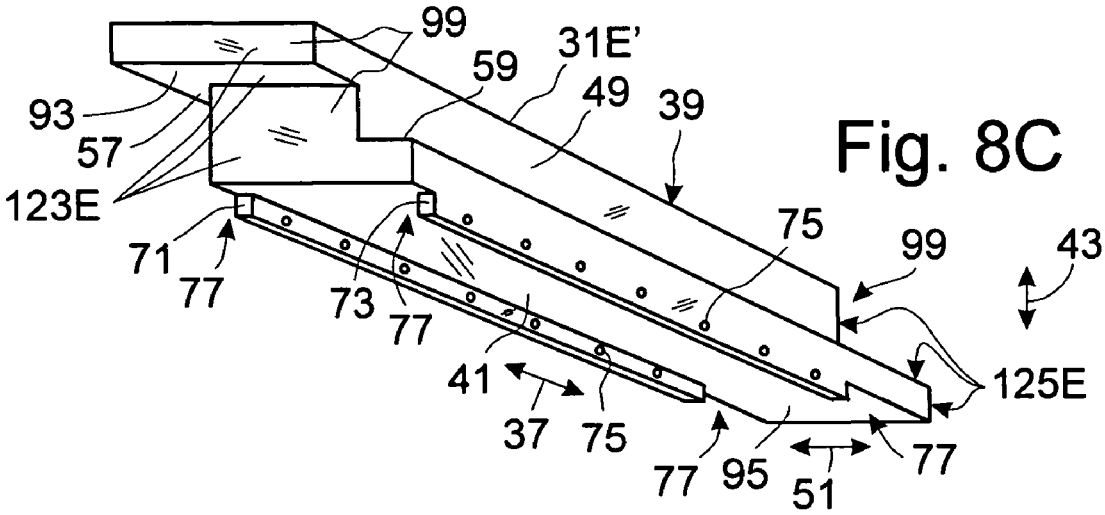

FIGS. 8A, 8B, and 8C show perspective views of modified versions of the armored building modules shown in FIGS. 1, 6B, and 7B respectively, wherein the otherwise open ends of channels (alias cavity 65 shown in FIGS. 1A, 6B, and 7B, and cavities 89 and 91 shown in FIGS. 6B and 7B) formed between component plates, inner flanges, and side members have been closed off by the incorporation of end members 97,99. FIG. 8A shows a first means 97 for closing an end of a cavity applied at opposite longitudinal ends to module 31A, i.e. to opposite longitudinal ends of a first cavity 65 (cavity 65 is shown in FIG. 1). FIG. 8B shows a first means 97 for closing an end of a cavity applied at opposite longitudinal ends to module 31B', i.e. to opposite longitudinal ends of a first cavity 65 (cavity 65 is shown in FIG. 6B). FIG. 8C shows a second means 99 for closing ends of cavities applied at opposite longitudinal ends to module 31E', i.e. to opposite longitudinal ends of a first cavity 65 and of second and third cavities 89,91 (cavities 65, 89, and 91 are shown in FIG. 7B). One skilled in the art will readily appreciate that the subject cavities 65,89,91 can be closed off at one end, or at both opposite ends individually, with any of a variety of cavity-terminating elements removably or permanently joined to the module. And one skilled in the art will readily appreciate that the subject cavities 65,89,91 can be closed off together at one end, or together at each of opposite ends, by using a Z-shaped end element such as 123,125 at the respective end to simultaneously close off multiple cavities 65,89,91. One skilled in the art will also recognize that use of means for closing end cavities can provide substantial increase to the load bearing strength of the modules and panels of this invention, whereas providing some holes to relieve air pressure within a module sustaining a mortar impact and explosion can relieve some internal stresses resulting from those pressures if desired, although this pressure is not seen as a significant mechanical issue.

Figure 9:
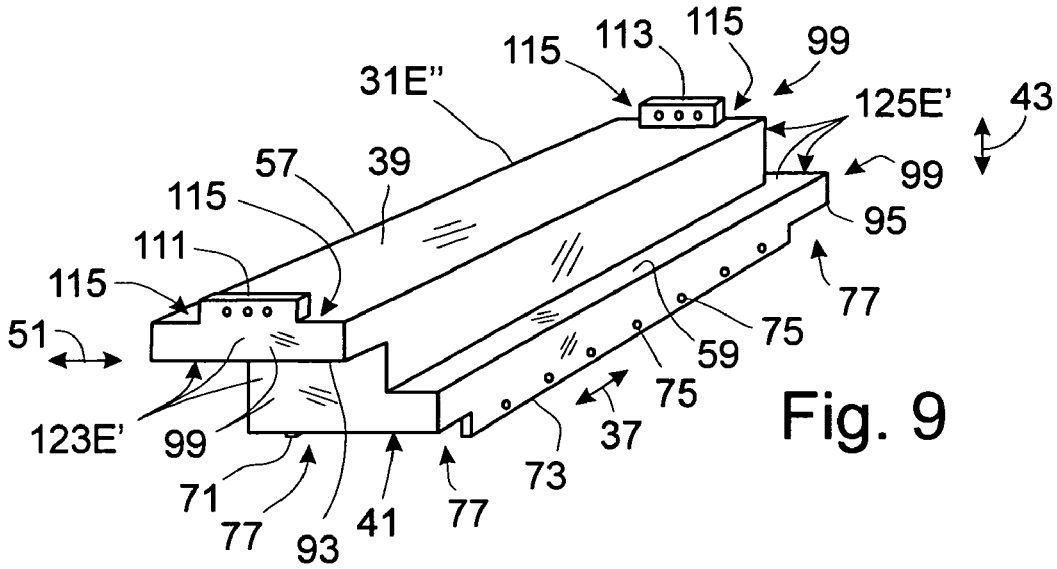
FIG. 9 shows a perspective view of a version of the second embodiment of an armored building module shown in FIG. 8C further including end means for securing the module to other modules in an end-to-end configuration. These end means for securing are shown as tab-like features located at the ends of the module and include holes for fasteners, wherein these tabs are located on an opposite face of the module relative to the side-mounted tabs.

FIG. 9 shows a perspective view of an again-modified version 31E" of the modified second embodiment of an armored building module 31E' shown in FIG. 8C, further including first 111 and second 113 end means for securing modules to one another in end-to-end alignment in an end-to-end configuration (as shown in FIGS. 14, 15D, and 15E). These end means for securing modules to one another 111, 113 are shown as tab-like features located at the ends of the module and include holes 75 for fasteners, wherein these tabs 111,113 are located on an opposite face of the module relative to the side-mounted tabs 71,73. Also shown is a side clearance in end tab 115 at each end of each end tab 111,113. This particular choice of placement of first and second end means for securing modules to one another 111,113 is preferred when the ends of the module 31E" are to be supported by a stringer running parallel to the sideways directions and when positioned to support the module at the ends of the module (as shown in FIG. 14).

Figure 10:
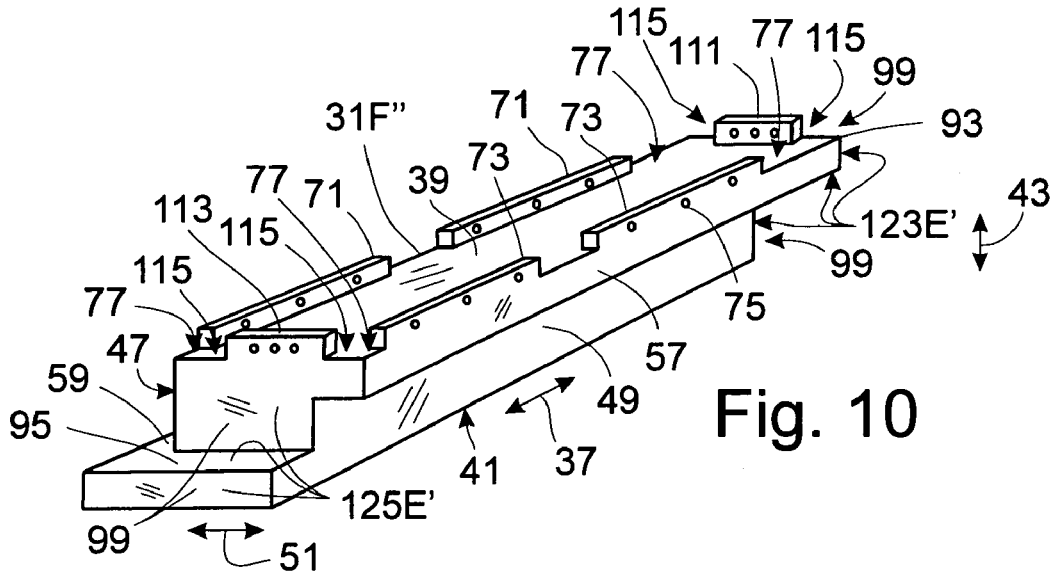
FIG. 10 shows a perspective view of a version of the second embodiment of an armored building module shown in FIG. 7C further including end means for securing the module to other modules in an end-to-end configuration. These end means for securing are shown as tab-like features located at the ends of the module and include holes for fasteners, wherein these tabs are located on the same face of the module as the side-mounted tabs.

FIG. 10 shows a perspective view of a modified version 31F" of the modified second embodiment 31F' of an armored building module shown in FIG. 7C, wherein the perspective has changed by rotating the module 31F' shown in FIG. 7C about an axis (not shown) that is parallel to the sideways directions 51, and adding both a) second means for closing ends of cavities 99 and b) end means for securing modules to one another 111,113 into an end-to-end configuration. These end means for securing modules to one another 111,113 are shown as tab-like features located at the longitudinal ends of the module and include holes 75 for fasteners, wherein these tabs are located on the same face 39 of the module as are the side tabs 71,73 that are examples of side means for securing modules to one another side-by-side. This particular configuration is useful when an installation of modules and panels requires that all securing elements be accessible at a common face, and that common face is not a face resting on supporting stringers. When used as elements in a roof, and with the side and end means for securing modules to one another 71,73, 111,115 all facing skyward, the side clearances 77 and end clearances 115, as well as gaps between multiple side means 71,73 along any one side of a module 31F", are useful to permit drainage of rain water from the roof.

Figure 11A:
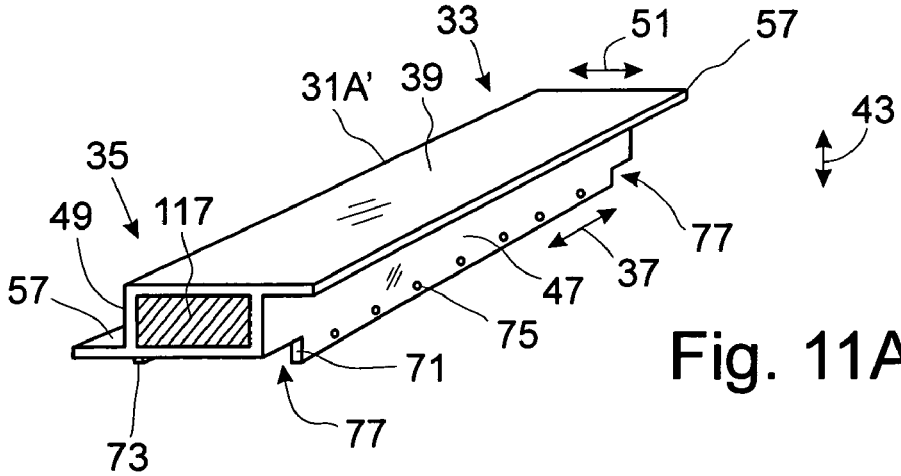
FIG. 11A shows a different perspective view of the modified first embodiment of an armored building module shown in FIGS. 2A and 2B, but wherein the channel formed between the plates and sides has contained within it an energy absorbing means for absorbing projectile and blast energies.

FIG. 11A shows a different perspective view of the modified first embodiment 31A' of an armored building module shown in FIGS. 2A and 2B, but wherein the channel (first cavity 65) formed between the plates 81,83 and first and second side members 47,49 contains energy absorbing means 117 for absorbing projectile and blast energy. One skilled in the art will readily appreciate that energy absorbing means 117 can include non-metals such as plastic, steel mesh, composites, and concrete, may include various shapes of these materials, such as longitudinally aligned tubes and bars, and need not entirely fill up the cavity.

Figure 11B:
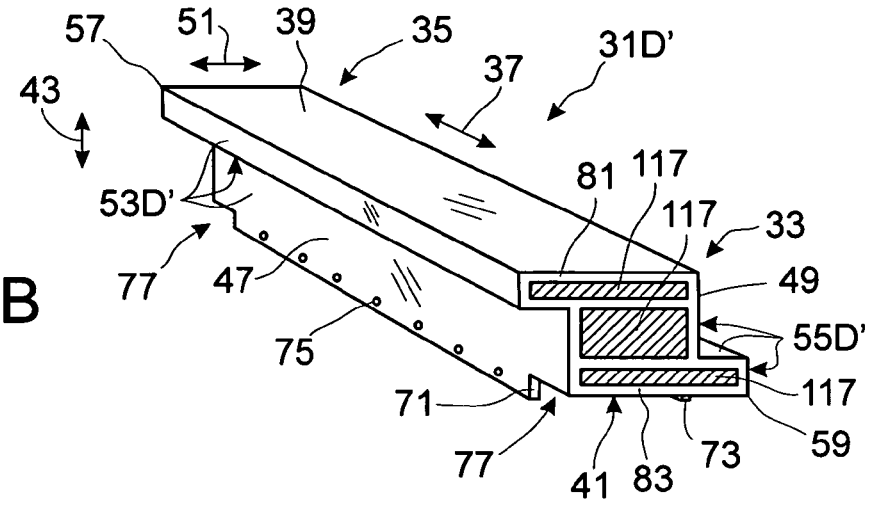
FIG. 11B shows a different perspective view of the modified second embodiment of an armored building module shown in FIGS. 4A and 4B, but wherein the channels formed between the plates and sides have contained within them energy absorbing means for absorbing projectile and blast energies.

FIG. 11B shows a different perspective view of the modified second embodiment 31D' of an armored building module shown in FIGS. 4A and 4B. Three cavities (channels) are shown containing energy absorbing means 117 for absorbing projectile and blast energies. These three cavities are: a) the first cavity 65 formed between the first and second inner flanges 85,87 and the first and second side members 47,49; b) the second cavity 89 formed between the first plate 81, the first inner flange 85, the first overhang web 67, and the second side member 49; and c) the third cavity 91 formed between the second plate 83, the second inner flange 87, the second overhang web 69, and the first side member 47.

Figure 12A:
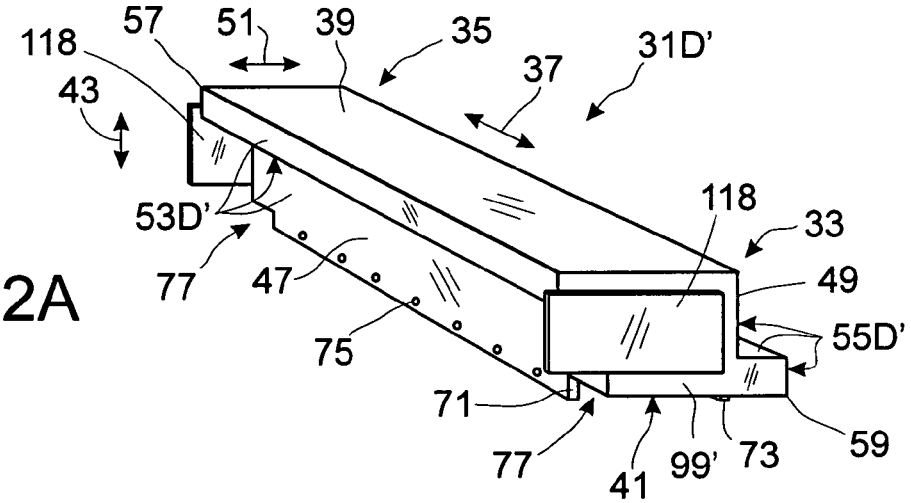
FIG. 12A shows a perspective view of the modified second embodiment of an armored building module shown in FIGS. 4A and 4B, but wherein a pair of pocket end caps is added to the module by attachment at the longitudinal ends of the module.

FIG. 12A shows a perspective view of the modified second embodiment 31D' of an armored building module shown in FIGS. 4A and 4B, but wherein second means 99 for closing ends of cavities have been added at the longitudinal ends 33,35, and wherein a pair of pocket end caps 118 is added to the module 31D' by attachment at the longitudinal ends 33,35 of the module. The utility of having pocket end caps 118 on modules is that these caps prevent the escape, from the ends 33,35 of the modules, of blast and projectile debris that might travel longitudinally along inter-module cavities formed between adjacent, side-by-side, modules within a panel, those inter-module cavities formed between a) a side lap overhang and adjacent side of one module and b) a side lap overhang and adjacent side of an adjacent module. Using end caps 118 on modules that don't have end lap overhangs, i.e. on modules such as 31A' and 31D', permits an individual module to be easily removed or replaced from its position within a panel of such modules without disturbing adjacent modules or panels, and without requiring additional longitudinal structural members running parallel to sideways directions 51 by which to block those inter-module cavities. FIG. 12A serves equally well to illustrate the presence of added end caps 118 at the longitudinal ends 33,35 of a modified second embodiment 31D' of an armored building module containing energy absorbing means 117, as was shown in FIG. 11B. FIG. 12A may serve equally well to illustrate the presence of added end caps 118 at the longitudinal ends 33,35 of a modified first embodiment 31A' of an armored building module shown in FIGS. 2A and 2B and even as shown in FIG. 11A if one substitutes the callouts 31A' for 31D', 53A' for 53D', and 55A' for 55D'.

Figure 12B:
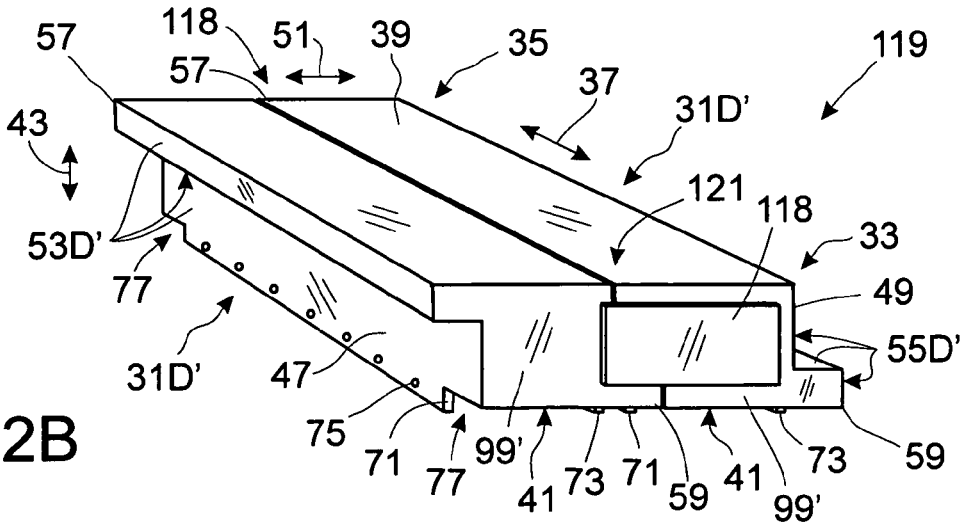
FIG. 12B shows a perspective view of two modified second embodiments of an armored building module shown in FIGS. 4A and 4B, wherein the two modules are positioned side-by-side and adjacent relative to one another, and wherein a pair of pocket end caps added to one of the modules functions to close off respective ends of a lap-joint-formed pocket that is a cavity formed between the modules.

FIG. 12B shows in perspective view an example of two armored building modules 119 assembled side-by-side and including a pair of pocket end caps 118. The two modules shown are modified second embodiments 31D' of the armored building module shown in FIGS. 4A and 4B but wherein second means 99 for closing ends of cavities have been added at the longitudinal ends 33,35, wherein the two modules 31D' are positioned side-by-side and adjacent relative to one another, and wherein a pair of pocket end caps 118 have been added to one of the modules. The function of the pair of pocket end caps 118 is to close off respective ends of a lap-joint-formed pocket 121 that is an inter-module cavity (hidden from view behind the pocket end cap 118 in the foreground of this perspective view) formed between side-by-side modules, be they modified versions of modules 31A or 31D. An example of an inter-module cavity is the lap-joint-formed pocket 121 as shown between modules 31E' in the next figure, FIG. 13A, where it is not hidden by a pocket end cap 118.

FIG. 13A shows an end view (along a longitudinal direction) of an example of an armored building panel 120 with three armored building modules assembled side-by-side. The three building modules shown are of the modified second embodiment 31E', i.e. without either a) optional means for closing ends of cavities 99 or b) first and second end means for securing modules to one-another 111,113 (as shown in FIG. 9). The modules 31E' shown are modified to include side means for securing modules to one-another 71', 73' (e.g. side tabs), wherein the side means 71' and 73' are modified with a slightly angled bend for clearance purposes in assembly and disassembly of the panel 120. Fastening means 127 for module-to-module securing (e.g. bolts and nuts) are also shown. FIG. 13A shows two air pockets 121, each of which is an instance of a lap-joint-formed pocket 121 or inter-module cavity formed between overlapping adjacent modules 31E'. Such lap-joint-formed pockets 121 are important to the modules of this invention; they permit modules to be easily removed and inserted (or replaced) within a panel, as would be required when replacing a damaged module in a war zone, without having to move adjacent modules. The utility of lap-joint-formed pockets 121 is better illustrated in FIGS. 16A through 16F that show how one module can be removed (or replaced) by a short sequence of translational movements relative to adjacent modules comprising a panel of such modules.

FIG. 13B shows an end view (along a longitudinal direction) of a wider module 129 that is a single armored building module of the modified second embodiment 31E', i.e. without either a) optional means for closing ends of cavities 99 or b) first and second end means for securing modules to one-another 111,113 (as shown in FIG. 9). The wider module 129 shown (wider version of earlier illustrated module 31E') is modified to include side means for securing modules to one-another 71, 73 (e.g. side tabs). The distance between the outermost portions of the sides of the module is shown in FIG. 13B as significantly larger than the distance between the outer plates 81,83.

In FIGS. 13A and 13B, the Z-shapes of first and second Z-shaped sides 53E' and 55E' are observable. FIG. 13A in particular illustrates a preferred arrangement of first and second plates 81,83, first and second inner flanges 85,87, and first and second Z-shaped sides 53E',55E'. One skilled in the art will appreciate that other configurations of these elements that comprise an individual module can accomplish the outward and inward shapes illustrated, and that the particulars of how each element abuts and joins to another can be modified to suit the builder or the customer. Single element Z-shaped sides (as shown) are preferred where the material thickness permits 90 degree bends, but each can instead be substituted with two or more separated side elements if it is desired to have the inner flanges extend outward sideways to serve as an otherwise middle leg of a Z-shape; examples follow in FIGS. 13C and 13D.

FIG. 13C is an end view showing an armored building module 31G' comprised of two outer plates 81,83 and only one inner flange 87, and having two sides 53G' and 55G', only the latter of which is actually Z-shaped. Both sides 53G' and 55G' have included side means for securing modules to one another 71,73.

FIG. 13D is an end view showing an armored building module exhibiting alternatives to how outer plates 81,83, inner flanges 85,87, and sides can be configured and inter-related. FIG. 13D shows an embodiment 31H' of an armored building module that illustrates examples of alternatives to how plate, flange, and side members can be inter-related. Note that side 53H' is not actually Z-shaped, and that it is straight and includes first side means 71 for securing modules to one another. Note too that side 55H' is Z-shaped only as it is comprised of multiple elements including (from top to bottom in the view) an edge of first plate 81, a second side member 49, a second side flange 68, a second overhang web 69, an edge of second plate 83, and a second side means 73 for securing modules to one another.

FIG. 14A shows an end view of an example of a single armored building module 131 comprising a set of five or more armored building modules 31E" of the modified second embodiment, the modules 31E" modified to incorporate side means 71,73 (not labeled) for securing modules to one-another (e.g. side tabs), fastening means 127 for module-to-module securing (e.g. bolts and nuts), and end means 111,113 (not labeled and one hidden) for securing modules to one-another (e.g. end tabs). FIG. 14A also shows a means for sealing 133 (e.g. a gasket) placed within each region of contact between side-ways adjacent modules, i.e. at the sides of modules 53E', 55E' where they are overhanging the adjacent module. In this invention and disclosure, a panel is generally to be construed as comprised of two or more armored building modules, with no limit to a maximum number.

FIG. 14B shows a perspective view of a single armored building panel 131 consisting in this example (example of an armored building panel 135) of five armored building modules 31E" of the modified second embodiment, the modules modified the same as shown in the previous FIG. 14A but here also showing lifting means 137 for lifting a module or panel, the lifting means 137 incorporated on the viewable face of each module.

Figure 15:
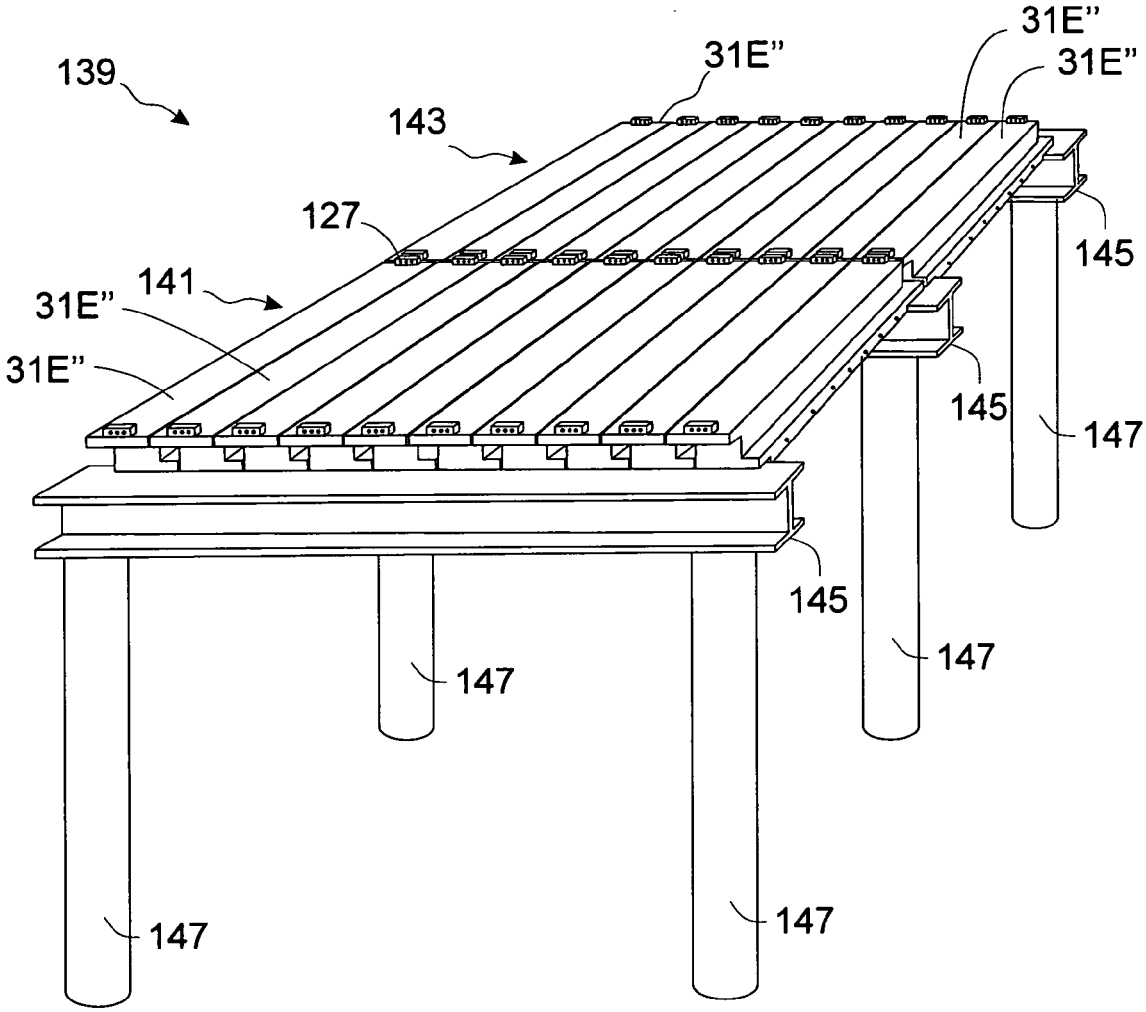
FIG. 15 shows a perspective view of two armored building panels secured end-to-end by end means for securing modules to one-another (e.g. end tabs) and used as a roof supported by I-beams for stringers, the stringers supported by vertical columns. In this example, each armored building panel consists of ten armored building modules of the modified second embodiment having both side means and end means for securing modules to one-another.

FIG. 15 shows a perspective view of two armored building panels (first course 141 of building modules and second course 143 of building modules, respectively) secured end-to-end by end means (not labeled in this view, but labeled in FIG. 9) for securing modules to one-another (e.g. end tabs) using multiple instances of fastening means 127 for module-to-module securing (e.g. a bolt and a nut) and used as a roof 139 supported by I-beams for stringers 145, the stringers supported by vertical support columns 147. In this example, each armored building panel 141,143 consists of ten armored building modules of the modified second embodiment 31E" having both side means 71,73 and end means 111,113 for securing modules to one-another (the side and end means are labeled in FIG. 9). The modules of the panels 141,143 can be fastened to the stringers 145 by any fastening means that would be obvious to one skilled in the art, for example by attaching brackets to the undersides (e.g. second faces 41 of each module 31E") of the panels 141,143 with which to implement clamping of each end of one or more modules to the upper flange of the I-beam stringers 145.

Figure 16A:
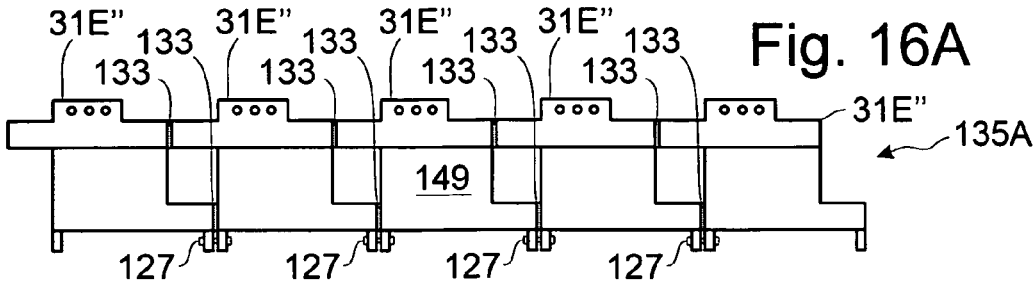
FIGS. 16A through 16F show a reversible sequence of states of armored building modules illustrating a step-wise process of removing one of the modules from an armored building panel comprised of the modules.
Figure 16B:
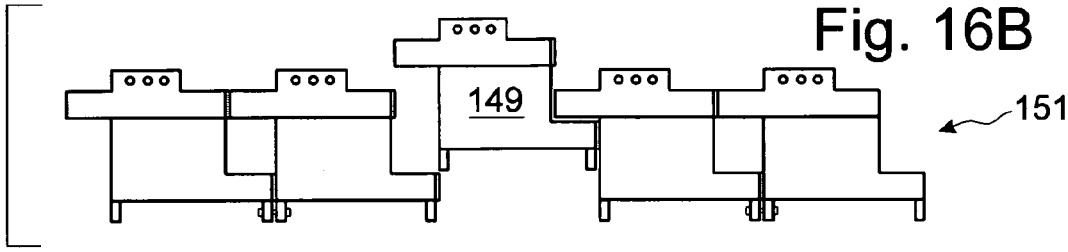
Figure 16C:
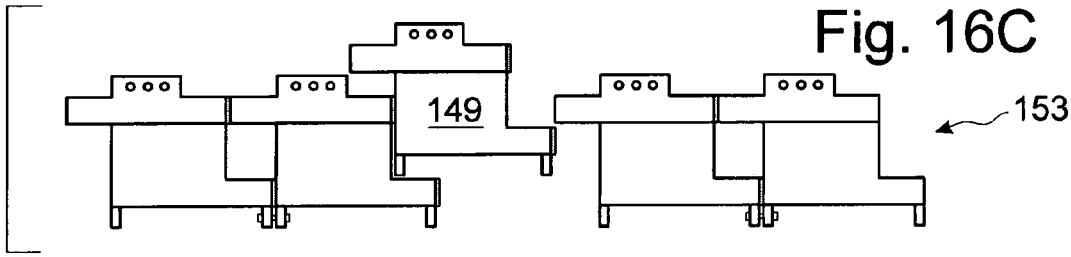
Figure 16D:
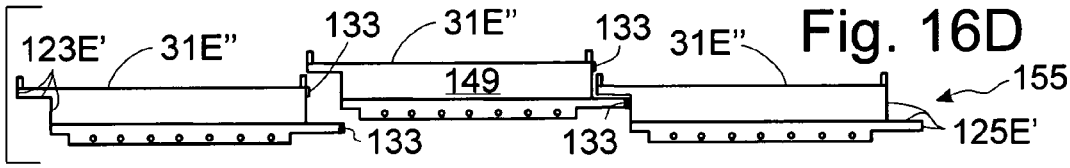
Figure 16E:
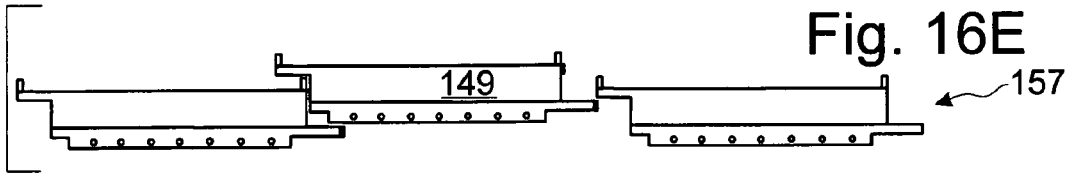
Figure 16F:
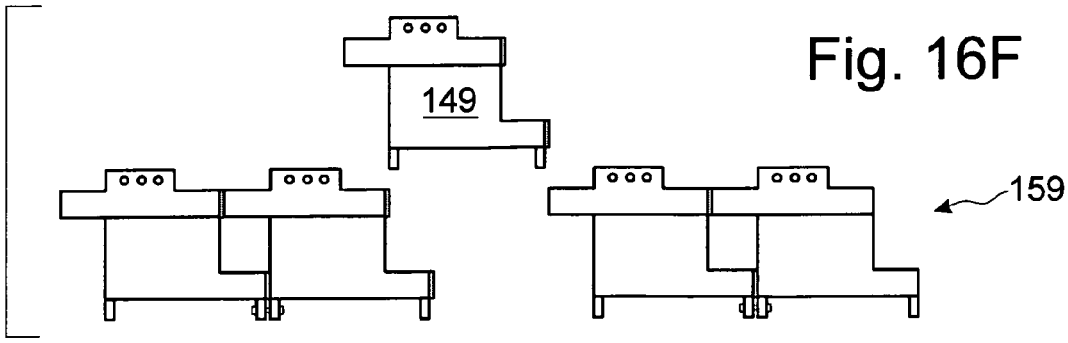

FIGS. 16A through 16F show a reversible sequence of states of armored building modules 31E" illustrating a step-wise process or method of removing one of the modules (armored building module for removal or replacement 149) from an armored building panel (example of an armored building panel 135) comprised of the modules 31E". This method, using armored building modules of the present invention, enables the removal, insertion, and therefore replacement of a module without moving adjacent modules. Other steps will become obvious to those skilled in the art. The steps shown that comprise the reversible method are the following:

Provide an armored building panel comprised of an end-to-end and side-by-side assembly of armored building modules (example of an armored building panel 135A is seen from end view in FIG. 16A), wherein the assembly includes an armored building module for removal or replacement 149 that is fastened to adjacent modules by multiple instances of fastening means 127 for module-to-module securing;

Remove from the module 149 the fastening means 127, followed by translating the module 149 in the faceways direction shown in the end view after this first faceways translation 151 (see FIG. 16B), and by the amount shown as determined by the interference between the lap sides that mutually collide;

Translate the module 149 in the sideways direction shown in the end view after this sideways translation 153 (see FIG. 16C), and by the amount shown as determined by the interference between sides that mutually collide (note that FIG. 16D shows a side view after this sideways translation 155);

Translate the module 149 in the endways direction shown in the side view after this endways translation 157 (see FIG. 16E), and by the amount shown as determined by the interference between ends that mutually collide;

Translate the module 149 in the faceways direction shown in the end view after this second faceways translation 159 (see FIG. 16F), and by the amount shown that clears module 149 from the assembly of modules making up the example of the armored building panel 135A.

One skilled in the art will recognize that the above described reversible method comprises a repair means for removal and insertion of individual modules in a group of modules comprising a panel. One skilled in the art will also recognize that the distances (i.e. dimensional extents) parallel to the facing directions, between side lap overhangs and between end lap overhangs, must be sufficiently large to avoid show-stopping interference between modules as one module is being removed and replaced.

One skilled in the art will appreciate that the current invention can use many other art-recognized elements equivalent to the disclosed and described examples of side means for securing modules to one another, end means for securing modules to one another, means for closing ends of cavities, fastening means for module-to-module securing, means for sealing, energy absorbing means for absorbing projectile and blast energy, and lifting means for lifting a module or panel. In all these "means for" elements of the current invention, it is intended that they be construed as encompassing any and every art-recognized technique for implementing the stated or implied functionality. In regard to the side means for securing modules to one another, it is the intention that their placements be construed to include their being extensions of or attachments to plates, side members, or Z-shaped sides. In regard to the end means for securing modules to one another, it is the intention that their placements be construed to include their being extensions of or attachments to plates, means for closing ends of cavities, or Z-shaped end elements. It is also intended that these placements, when construed as attachments at a side of a plate, be construed to include locations set inward from the side of the plate. And it is intended that these placements, when construed as attachments to an end of a plate, be construed to include locations set inward from the end of said plate.

One skilled in the art will also appreciate that armored building modules of the current invention can use additional inner flanges than the numbers illustrated and that they need not all be parallel to outer plates.

One skilled in the art will also appreciate that armored building modules and armored building panels of the current invention can be constructed to include bends that negotiate angles required in a roof, wall, partition, floor, or door.

One skilled in the art will also appreciate, whereas armored building panels of the current invention have been described and illustrated within this disclosure using specific examples having specific numbers of individual modules arranged in a row and/or end-to-end, that the current invention extends to armored building panels comprised of many more than a few individual armored building modules.

Although the invention is described with respect to preferred embodiments, modifications thereto will be apparent to those skilled in the art. Therefore, the scope of the invention is to be determined by reference to the claims that follow.

We claim:

1. An armored building module for placement adjacent to similar armored building modules, comprising:

a. a first plate having two ends spaced apart longitudinally in a first direction and having two sides spaced apart transversely in a second direction;

b. a second plate having two ends spaced apart longitudinally in said first direction and having two sides spaced apart transversely in said second direction, wherein said second plate is parallel to said first plate and spaced apart from said first plate in a third direction that is perpendicular to both the first and second directions; and c. a first side member and a second side member spaced apart from one another in said second direction and each having two ends spaced apart in said first direction, wherein each of the first and second side members is attached to both said first plate and said second plate;

wherein said first and second side members comprise two opposite sides of said armored building module in said second direction;

wherein the ends of said first and second plates comprise two opposite ends of said armored building module in said first direction;

wherein a portion of said first plate comprises a first side lap overhang that extends parallel to said second direction, away from the first and second side members, and beyond a nearer of the sides of said second plate; and wherein a portion of said second plate comprises a second side lap overhang that extends parallel to said second direction, away from the first and second side members, and beyond a nearer of the sides of said first plate;

whereby said armored building module can be placed side-by-side adjacent to said similar armored building modules thereby forming an armored building panel useful for providing complementary overlapping of their respective side lap overhangs for protection that is continuous from module to module against penetration of explosion debris from mortar shells, and permitting removal and replacement of said armored building module from said armored building panel without requiring the moving of the adjacent similar armored building modules.

2. The armored building module of claim 1, further comprising two end members that are spaced apart from one another along said first direction, wherein each end member is attached to both the first and second plates and the first and second side members.

3. The armored building module of claim 1, further comprising:

a. a first end lap overhang that is an end extension of said first plate parallel to said first direction; and b. a second end lap overhang that is an end extension of said second plate parallel to said first direction but opposite in direction to the extension of said first plate;

whereby said armored building module can be placed end-to-end adjacent to said similar armored building modules providing complementary overlapping of their respective end lap overhangs for protection that is continuous from module to module.

4. The armored building module of claim 1, further comprising:

a. a first inner flange attached to the first and second side members; and b. a second inner flange attached to the first and second side members;

wherein the first and second inner flanges are co-parallel to said first plate, are spaced apart in said third direction from one another and from said first and second plates, and are situated between said first and second plates, wherein said first inner flange is closer to said first plate than is said second inner flange;

wherein said first inner flange comprises a portion of said first side lap overhang; and wherein said second inner flange comprises a portion of said second side lap overhang.

5. The armored building module of claim 4, wherein said two opposite sides are each roughly Z-shaped in a cross-section taken perpendicular to said first direction.

6. The armored building module of claim 4, wherein said first and second plates, said first and second inner flanges, and said first and second side members are extruded together as a monolithic structure.

7. The armored building module of claim 4, further comprising:

a. a first end lap overhang that is an end extension of said first plate and said first inner flange both parallel to said first direction; and b. a second end lap overhang that is an end extension of said second plate and said second inner flange both parallel to said first direction but opposite in direction to the end extension of said first plate and of said first inner flange;

whereby said armored building module can be placed end-to-end adjacent to said similar armored building modules providing complementary overlapping of their respective end lap overhangs for protection that is continuous from module to module.

8. The armored building module of claim 4, further comprising two end members that are spaced apart from one another along said first direction, wherein each end member is attached to both the first and second plates and the first and second side members.

9. The armored building module of claim 8, wherein the first and second end members are each roughly Z-shaped in a cross-section taken perpendicular to said second direction.

10. The armored building module of claim 8, further comprising means for module-to-module securing of said armored building module to similar modules located side-by-side to said armored building module.

11. The armored building module of claim 8, further comprising means for module-to-module securing of said armored building module to similar modules located end-to-end to said armored building module.

12. The armored building module of claim 8, further comprising means for module-to-module sealing of said armored building module to similar modules located next to said armored building module.

13. The armored building module of claim 8, further comprising energy absorbing means for absorbing projectile and blast energy, wherein said energy absorbing means is located between a pair selected from the group consisting of the pair of first and second inner flanges, the pair that is the first plate and the first inner flange, and the pair that is the second plate and the second inner flange.

14. The armored building module of claim 8, further comprising:

a. an overall width measured in the second direction; and b. an overall thickness measured in the third direction;

wherein said overall thickness is less than 30 centimeters, and said overall width is more than 60 centimeters.

15. The armored building module of claim 8, wherein said first and second plates, said first and second inner flanges, and said first and second side members are made of steel.

16. The armored building module of claim 14, wherein said first and second plates, said first and second inner flanges, and said first and second side members are joined by welding.

17. An armored building panel for defense against mortar attacks, comprising:

a. a set of longitudinally extended armored building modules each having two opposite sides and arranged side-by-side to form a course of modules, wherein each of the modules abuts another of the modules in a contiguous succession from a first to a last in the set of modules; and wherein each pair of modules that lie adjacent to one-another interface at their sides with non-contacting and complementary side lap overhangs as viewed in a transverse cross-section; and b. means for fastening said armored building modules to one another side-by-side;

wherein the armored building modules are each comprised of a respectively associated set of longitudinally extended and co-parallel plates that are interposed between two side members that support the associated plates along the sides of the plates, wherein each of the plates has two opposite co-parallel faces, and wherein each of the plates is spaced apart from the other plates in the module in a direction perpendicular to said faces of the module; and wherein each of said side members has a Z-shape that conforms with some of the plates of its associated module extending farther toward that side member than the other plates.

18. The armored building panel of claim 17, wherein the panel comprises a roof over top of one selected from the group consisting of a person and equipment.

19. The armored building panel of claim 17, wherein the panel comprises a part of a building, the part selected from the group consisting of a roof, a floor, a wall, a door, and a partition.

20. A substantially hollow panel for placement side-against-side similar panels, having at least opposite first and second sides that respectively include a front side-projection and a back side-projection such that abutted first and second sides of two adjacent panels create a hollow channel running substantially the length of the abutted sides;

wherein said hollow panel can be removed from between similarly abutted adjacent panels without requiring rotation of the panel or movement of adjacent panels.

* * * * *